US010286404B2

(12) United States Patent
Starkey et al.

(10) Patent No.: US 10,286,404 B2
(45) **Date of Patent: *May 14, 2019**

(54) DETECTING UNINTENDED OBJECTS IN UNDER-SINK DISPOSAL

(71) Applicant: SAMELIN INNOVATIONS, LLC, Wilmington, NC (US)

(72) Inventors: Michael Starkey, Kent, OH (US); Juan Carlos Perez, Charlotte, NC (US); Raeshon McNeil, Charlotte, NC (US); Kurt Alan Jordan, Charlotte, NC (US); Richard Fletcher, Cambridge, MA (US)

(73) Assignee: Samelin Innovations, LLC, Wilmington, NC (US)

( * ) Notice: Subject to any disclaimer, the term of this patent is extended or adjusted under 35 U.S.C. 154(b) by 680 days.

This patent is subject to a terminal disclaimer.

(21) Appl. No.: 14/823,940

(22) Filed: Aug. 11, 2015

(65) Prior Publication Data

US 2016/0040413 A1 Feb. 11, 2016

Related U.S. Application Data

(60) Provisional application No. 62/036,108, filed on Aug. 11, 2014.

(51) Int. Cl.
*B02C 25/00* (2006.01)
*E03C 1/266* (2006.01)
(Continued)

(52) U.S. Cl.
CPC ..... *B02C 25/00* (2013.01); *B02C 18/0084* (2013.01); *B02C 18/0092* (2013.01);
(Continued)

(58) Field of Classification Search
CPC . B02C 25/00; B02C 18/0084; B02C 18/0092; B02C 23/36
(Continued)

(56) References Cited

U.S. PATENT DOCUMENTS 3,424,879 A 1/1969 Shlesinger
4,089,474 A 5/1978 Timmer
(Continued)

FOREIGN PATENT DOCUMENTS

JP 8168686 7/1996
JP 2007090146 4/2007

*Primary Examiner* — Faye Francis
(74) *Attorney, Agent, or Firm* — Chad D. Tillman; Tillman Wright, PLLC

(57) ABSTRACT

A disposal system includes a sink; a disposal unit located under the sink and connected in fluid communication with a drain of the sink; a control unit configured to operate the disposal unit; and means for detecting an unintended object that passes through the drain of the sink and enters the disposal unit, resulting in stopping operation of the disposal unit. The means for detecting an unintended object that enters the disposal unit resulting in stopping operation of the disposal unit comprises a sensor and associated circuitry that detects an unintended object and triggers the control unit to stop operation. In different preferred embodiments the sensor respectively includes a capacitive sensor; a capacitive plate; magnetic shielding surrounding the disposal unit in the area of the sensor; a double "D" coil arrangement; a concentric detection coil for detecting magnetic ringdown; an ultrasonic sensor; a microphone; and combinations thereof.

20 Claims, 27 Drawing Sheets

(51) Int. Cl.
*B02C 18/00* (2006.01)
*B02C 23/36* (2006.01)
*B02C 23/04* (2006.01)

(52) U.S. Cl.
CPC ..... *B02C 23/04* (2013.01); *B02C 23/36* (2013.01); *E03C 1/2665* (2013.01)

(58) Field of Classification Search
USPC ..... 241/36, 46.013–46.015
See application file for complete search history.

(56) References Cited

U.S. PATENT DOCUMENTS 4,100,491 A 7/1978 Newman, Jr. et al.
4,216,916 A 8/1980 Tupper
4,253,616 A 3/1981 Timmer
4,742,339 A 3/1988 Baziuk
5,205,019 A 4/1993 Schnlichter
5,318,229 A 6/1994 Brown
5,576,621 A 11/1996 Clements
5,610,516 A 3/1997 Maier
5,921,071 A 7/1999 Paquet
6,618,873 B2 9/2003 Mulgrew
6,636,135 B1 10/2003 Vetter
7,066,415 B2 6/2006 Strutz
7,163,164 B2 1/2007 Diaz
7,296,683 B1 11/2007 Vallelonga
7,533,835 B2 5/2009 Hanson
7,791,506 B2 9/2010 Riihimaki
7,936,242 B2 5/2011 Carpenter
7,967,225 B1 6/2011 Schulz
8,322,641 B2 12/2012 Jeon
8,584,976 B1 11/2013 Melin
8,740,115 B1 6/2014 Melin
9,194,112 B1 11/2015 Melin
9,194,113 B1 11/2015 Melin
9,555,417 B1 1/2017 Melin
9,556,599 B2 1/2017 Starkey
2004/0000904 A1 1/2004 Cotter
2007/0181718 A1 8/2007 Hanson
2008/0067270 A1 3/2008 Strutz
2010/0133370 A1 6/2010 Flynn
2013/0112791 A1 5/2013 Jeon
2013/0175373 A1 7/2013 Morgan
2013/0186573 A1 7/2013 Kulesa
2013/0327858 A1 12/2013 Rees

DETECTING UNINTENDED OBJECTS IN UNDER-SINK DISPOSAL

CROSS-REFERENCE TO RELATED APPLICATION

The present application is a U.S. nonprovisional patent application of, and claims priority under 35 U.S.C. § 119(e) to, U.S. provisional patent application Ser. No. 62/036,108, filed Aug. 11, 2014, which provisional patent application is incorporated by reference herein. The disclosure of this provisional application is set forth in the Appendix, which is incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to under-sink disposals. Such disposals are commonly found in most U.S. homes, and are designed to shred organic material prior to entering a sewer system. They are not designed to handle bottle caps, jar lids, or utensils such as a knife, fork, or spoon, let alone the occasional piece of jewelry, such as a wedding ring. Indeed, when such items are inadvertently dropped or otherwise fall into the disposal, the disposal breaks, the item is damaged or destroyed, or both. In view of this, it is believed that a need exists for improvement in under-sink disposals in order to address the situation in which a utensil or other metallic object is accidentally dropped into or otherwise inadvertently enters the disposal.

Such need is addressed in the solutions disclosed in U.S. Pat. Nos. 8,584,976 and 8,740,115, each of which is incorporated herein by reference; however, it is believed that additional improvements can yet be made in the manner and efficiency with which unintended objects—such as metallic objects—are detected in the disposal, such as further focusing on filtering of noise and shielding of unwanted environmental effects. This—and other needs—are addressed by one or more aspects and features of the present invention disclosed herein.

SUMMARY OF THE INVENTION

The present invention generally relates to apparatus and methods for detecting unintended objects in under-sink disposals and, in particular, to apparatus and methods for detecting unintended—and especially metallic—objects that fall into or otherwise enter under-sink disposals.

In an aspect of the present invention, an apparatus includes: a disposal unit; a control unit configured to stop operation of the disposal unit; and a sensor and associated circuitry for detecting unintended objects that enter the disposal unit. The control unit is triggered to stop operation of the disposal unit upon the detection of such object that has entered the disposal unit.

In a feature of this aspect, the control unit turns off power to the disposal unit when an unintended object is detected to have entered the disposal unit.

In a feature, the control unit turns off power to the disposal unit when an unintended object is detected in the disposal unit.

In a feature, the control unit causes active braking of the shredding mechanism of the disposal unit such that the disposal unit stops functioning faster than if power were merely turned off to the disposal unit.

In another aspect, an apparatus includes: a disposal unit; a control unit configured to stop operation of the disposal unit; and a sensor and associated circuitry for detecting unintended objects that enter the disposal unit. The control unit is triggered to stop operation of the disposal unit upon the detection of such objects that have entered the disposal unit. The sensor comprises a capacitive sensor or capacitive plate that is attached to the disposal unit. The sensor does not encircle the disposal unit. The apparatus further comprises shielding that is applied around the disposal unit proximate the area of the sensor. The shielding may comprise a plate that is attached to and encircles the disposal unit. The sensor and shielding are located above the shredding area such that unintended objects that enter the disposal unit are detected prior to reaching the shredding area, i.e., the location at which shredding occurs, whereby the motor can be deactivated preferably before shredding of the object is attempted.

In another aspect, an apparatus includes: a disposal unit; a control unit configured to stop operation of the disposal unit; and a sensor and associated circuitry for detecting unintended objects that enter the disposal unit. The control unit is triggered to stop operation of the disposal unit upon the detection of such objects that have entered the disposal unit. The sensor comprises a sensor having a double "D" coil arrangement whereby the detection field is shaped for better chance of detecting eddy currents in metals. The detection field preferably is shaped to be generally planar in its extent through the travel path of objects entering the shredding area of the disposal unit. The double "D" sensor preferably includes two "D" shaped coils arranged in generally mirror image to each other. Furthermore, preferably the signature detected is compared to reference signatures and is used to determine the type of metal of an object passing through the detection field. Preferably, during installation, the sensor is calibrated to take into consideration environmental effects of the specific installation. In at least one embodiment, the sensor is configured to detect precious metals, such as gold found in rings. Preferably, the sensor is attached to a side of the disposal unit and does not encircle the disposal unit. The apparatus further comprises shielding that is applied around the disposal unit proximate the area of the capacitive sensor. The shielding may comprise a plate that is attached to and that encircles or surrounds the disposal unit. The sensor and shielding are located above the shredding area such that objects are detected prior to reaching the shredding area, i.e., the location at which shredding occurs, whereby the motor can be deactivated preferably before shredding of the object is attempted and any damage is incurred.

In another aspect, an apparatus includes: a disposal unit; a control unit configured to control operation of the motor of the disposal unit; and a sensor and associated circuitry for detecting unintended objects in the shredding area of the disposal unit when the motor of the disposal unit is first started for shredding. The control unit is triggered to stop operation of the disposal unit upon the detection of such objects that have entered the disposal unit. The sensor comprises a microphone that is attached to the disposal unit. The sensor in at least some embodiments is located below the shredding area and, in other embodiments, the microphone is located above the shredding area. When the motor is activated, the motor undergoes an initial series of lower revolutions per second, and the sensor listens to determine if frequency and amplitude readings match normal ranges. Preferably, the rpms are sufficiently low that a metallic object present in the shredding area will not be damaged and the shredding mechanism of the disposal unit will not be damaged. A metallic object, for example, will have a distinct frequency and amplitude, and the presence of a metallic object in the shredding area can be determined based on a signature such object exhibits that otherwise is not present. If detected, the motor is deactivated; if no signature is detected so as to indicate presence of a metallic or other object for which signature the sensor data is screened, then the rpms of the motor is increased for normal shredding operations. The initial phase should be short enough that a user would not notice a delay in operation of the disposal unit when no unintended object is detected in the shredding area.

In another aspect, an apparatus includes: a disposal unit; a control unit configured to stop operation of the disposal unit; and a sensor and associated circuitry for detecting unintended objects that enter the disposal unit. The control unit is triggered to stop operation of the disposal unit upon the detection of such objects that have entered the disposal unit. The sensor comprises an ultrasonic sensor that is attached to the disposal unit and does not encircle the disposal unit. The ultrasonic sensor is configured to detect densities of objects passing thereby into the shredding area of the shredding mechanism. The sensor is located above the shredding area such that objects are detected prior to reaching the shredding area, i.e., the location at which shredding occurs, whereby the motor can be deactivated preferably before shredding of the object is attempted and any damage is incurred.

In another aspect, an apparatus comprises a disposal unit; a control unit configured to operate the disposal unit; and means for detecting an unintended object that enters the disposal unit resulting in stopping operation of the disposal unit.

In a feature of this aspect, the means for detecting an unintended object that enters the disposal unit resulting in stopping operation of the disposal unit comprises a sensor and associated circuitry that detects an unintended object that enters the disposal unit and that triggers the control unit to stop operation of the disposal unit.

In different preferred embodiments of this aspect, the sensor respectively comprises a capacitive sensor; a capacitive plate; magnetic shielding surrounding the disposal unit in the area of the sensor; a double "D" coil arrangement; a concentric detection coil for detecting magnetic ringdown; an ultrasonic sensor; a microphone; and combinations thereof.

In another aspect, a disposal system comprises a sink; a disposal unit located under the sink and connected in fluid communication with a drain of the sink for receiving waste for shredding during operation of the disposal unit; a control unit configured to operate the disposal unit; and means for detecting an unintended object that passes through the drain of the sink and enters the disposal unit, resulting in stopping operation of the disposal unit.

In a feature of this aspect, the means for detecting an unintended object that enters the disposal unit resulting in stopping operation of the disposal unit comprises a sensor and associated circuitry that detects an unintended object that enters the disposal unit and that triggers the control unit to stop operation of the disposal unit.

In different preferred embodiments of this aspect, the sensor respectively comprises a capacitive sensor; a capacitive plate; magnetic shielding surrounding the disposal unit in the area of the sensor; a double "D" coil arrangement; a concentric detection coil for detecting magnetic ringdown; an ultrasonic sensor; a microphone; and combinations thereof.

In yet other aspects, each of the foregoing apparatus includes a combination of the foregoing sensors.

Other aspects of the invention comprise methods of using apparatus of the foregoing aspects.

Still other aspects comprise kits for up-fitting conventional disposal systems to those disclosed herein. Alternatively, one or more of the foregoing aspects and features can be integrated into a disposal system as manufactured and provided by an "OEM".

Still other aspects and features are disclosed in the incorporated provisional application.

Still other aspects and features are disclosed in the drawings.

BRIEF DESCRIPTION OF THE DRAWINGS

One or more preferred embodiments of the present invention now will be described in detail with reference to the accompanying drawings.

DETAILED DESCRIPTION

Figure 1:
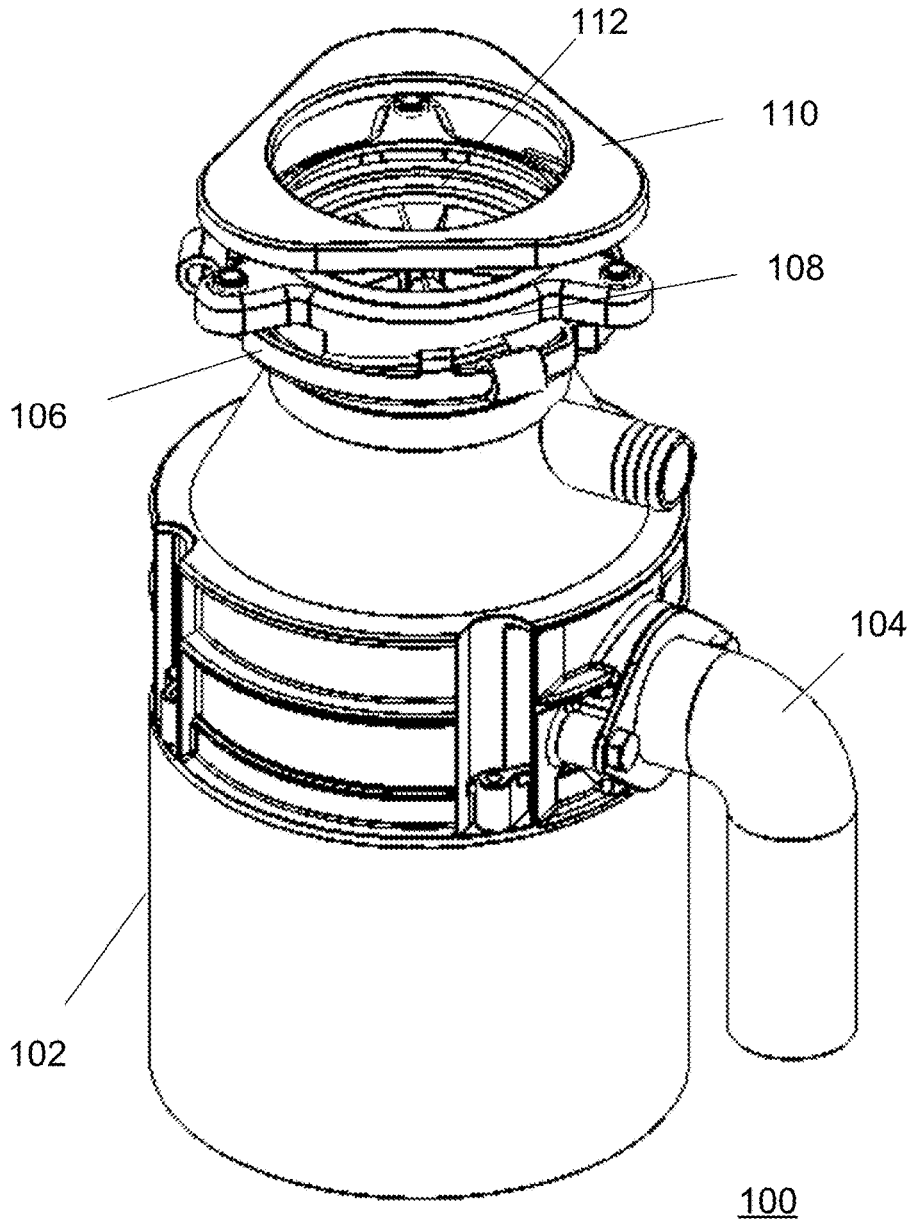
FIG. 1 is a perspective view of a disposal unit.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112, subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Figure 1A:
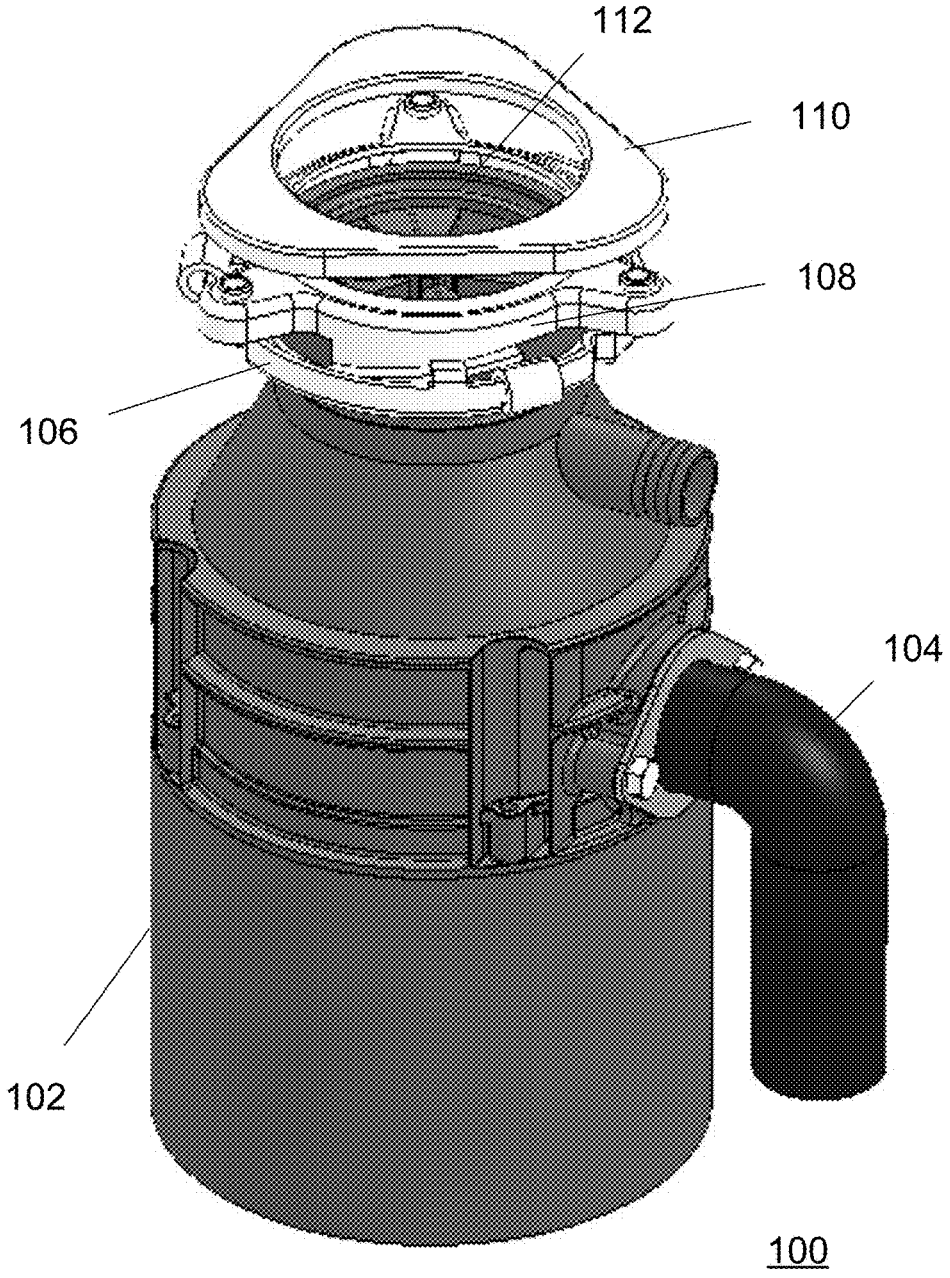
FIG. 1A is a shaded view of FIG. 1.
Figure 2:
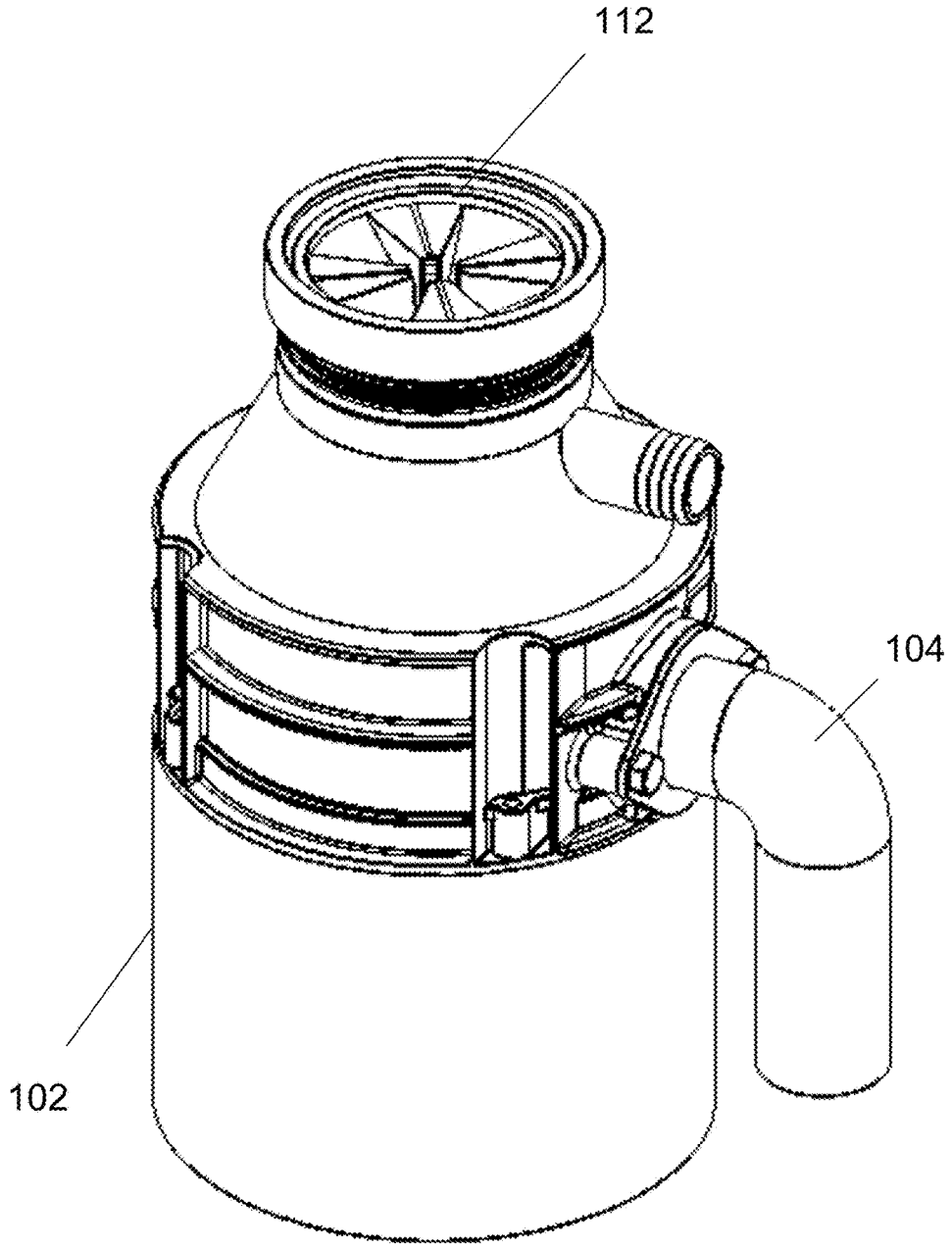
FIG. 2 is a perspective view of the disposal unit of FIG. 1 in which some components are omitted for clarity of illustration.
Figure 2A:
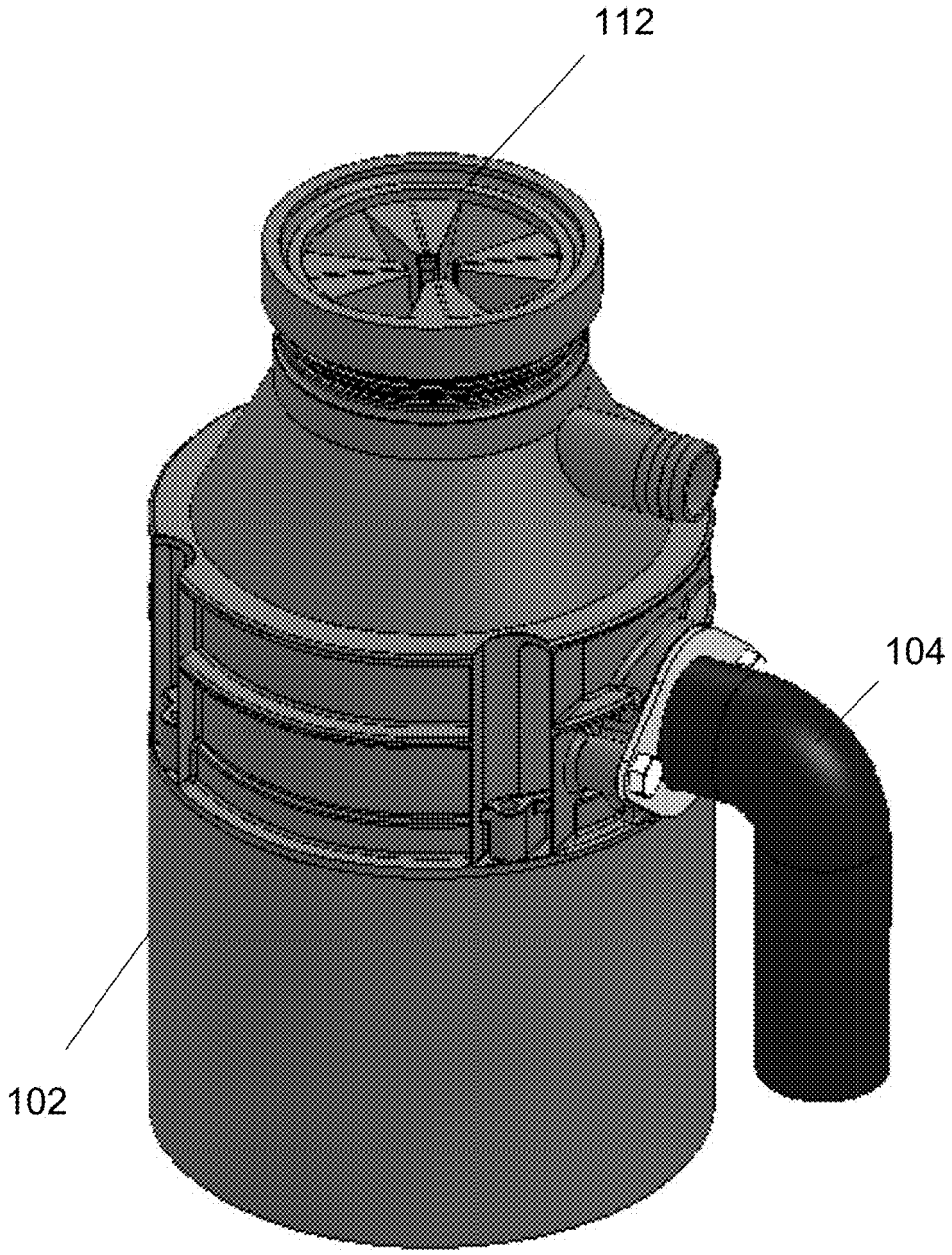
FIG. 2A is a shaded view of FIG. 2.
Figure 3:
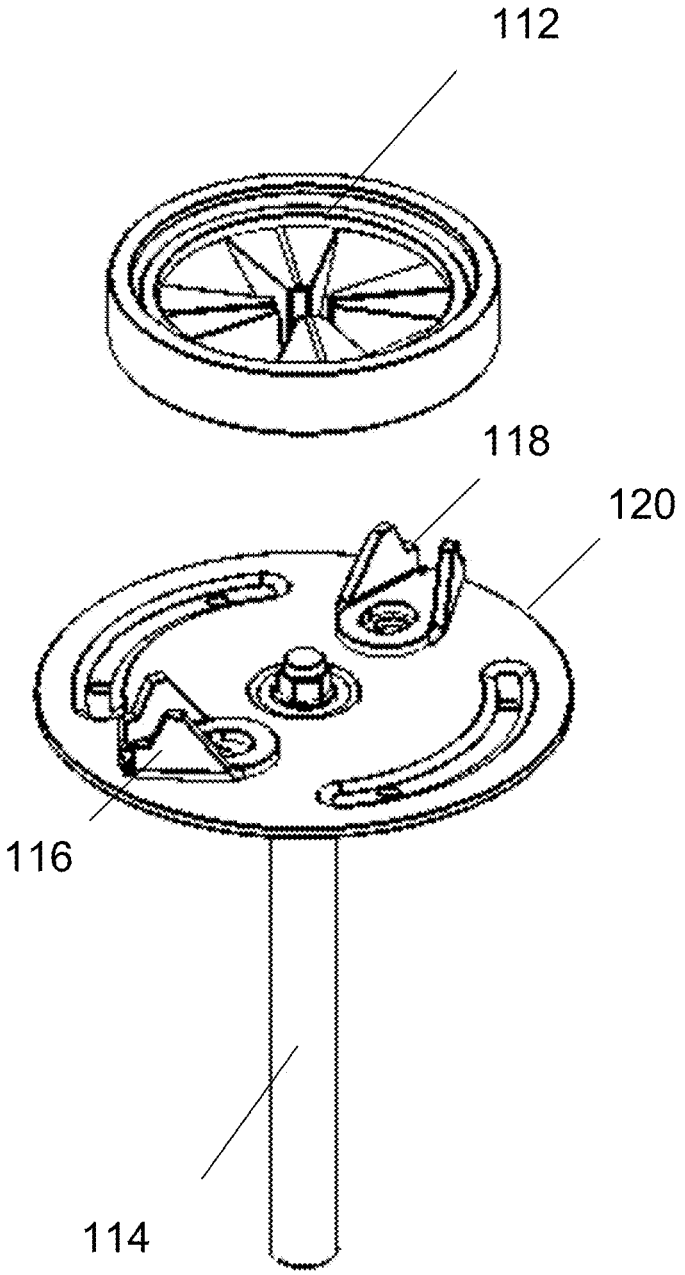
FIG. 3 is a perspective view of the disposal unit of FIG. 2 in which some additional components are omitted for clarity of illustration.
Figure 3A:
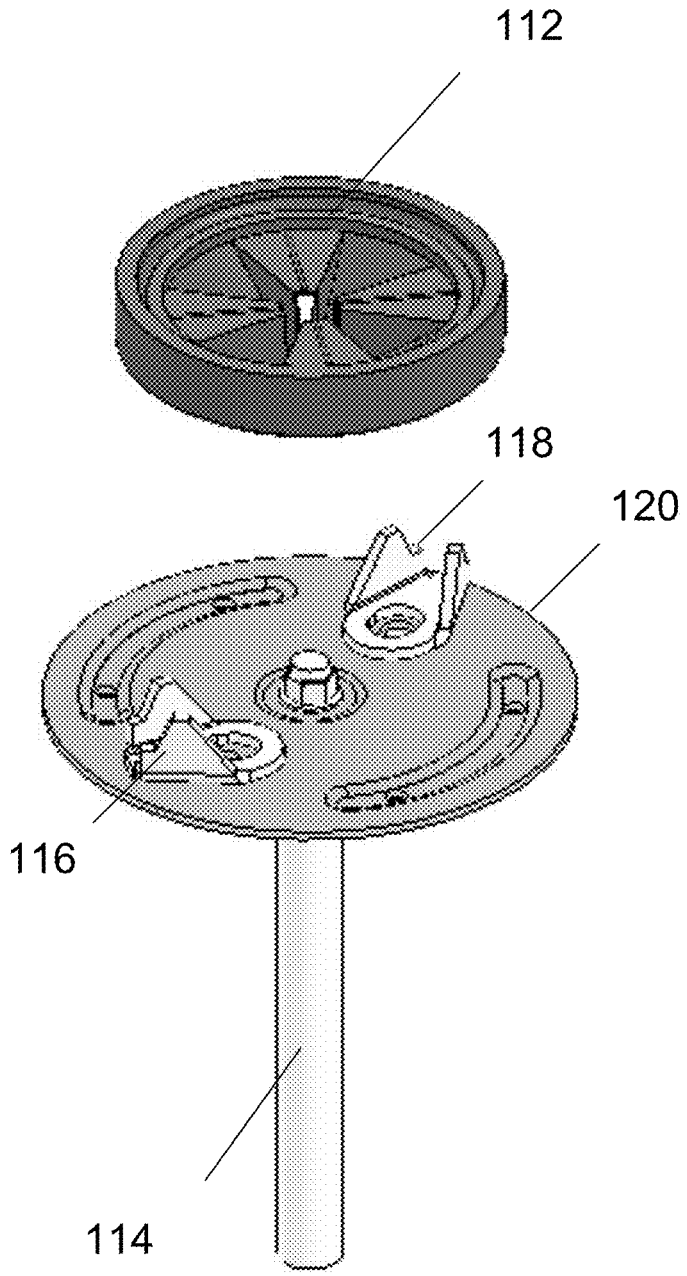
FIG. 3A is a shaded view of FIG. 3.

FIG. 1 is a perspective view of a disposal unit 100, and FIG. 1A is a shaded view of the disposal unit 100. Similarly, FIG. 2 is a perspective view of the disposal unit 100 of FIG. 1 in which some components are omitted for clarity of illustration, and FIG. 2A is a shaded view thereof; FIG. 3 is a perspective view of the disposal unit 100 of FIG. 2 in which some additional components are omitted for clarity of illustration, and FIG. 3A is a shaded view thereof.

The disposal unit 100 is representative of major components of disposal units used in various preferred embodiments of the invention. As shown in FIGS. 1 and 2, components of the disposal unit 100 include a disposal body 102, a tailpipe 104, a disposal body flange 106, a mounting ring 108, a backup ring 110, and a mounting gasket 112. As shown in FIG. 3, components used in shredding of waste during operation of the disposal unit 100 include a body axle 114, grinding tooth 116, grinding tooth 118, and endframe 120.

Figure 4:
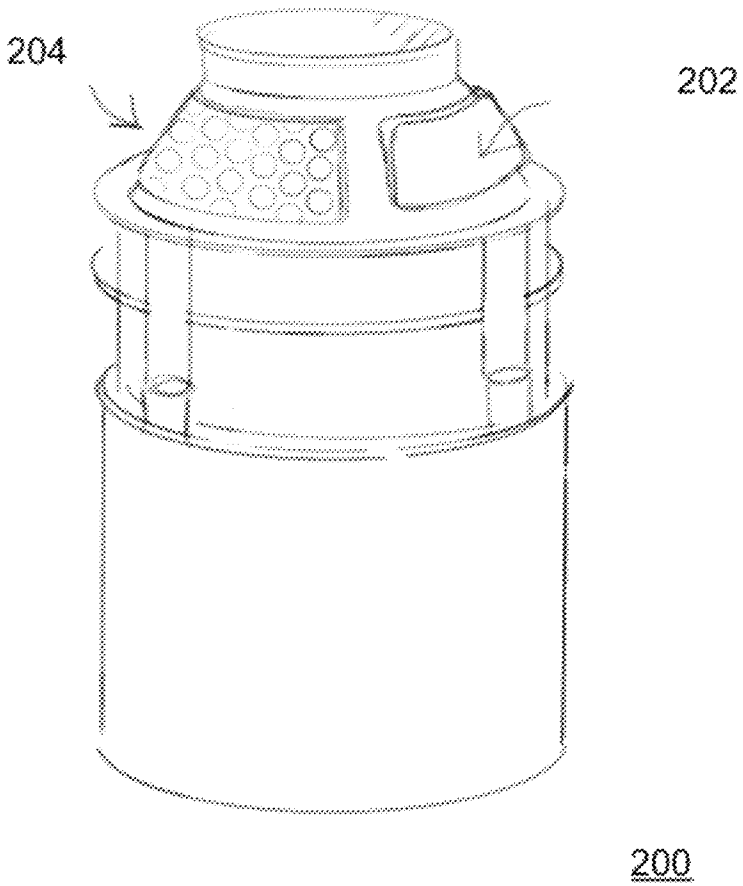
FIG. 4 is a schematic illustration of an embodiment of the invention in which the sensor comprises a capacitive plate that is used in combination with shielding.

Preferred embodiments of aspects and features of the invention are now described in detail within the context of components of disposal units as represented by disposal unit 100. In this respect, FIG. 4 is a schematic illustration of an embodiment of the invention comprising a disposal unit 200 of which disposal unit 100 is representative, and with which a sensor 202 is provided comprising a capacitive plate that is used in combination with shielding 204. In use, the capacitance of the sensor 202 is monitored. If a metallic object passes through the throat of the disposal unit 100, the capacitance read for the plate will change indicating detection of the metallic object. The shielding 204 is believed to reduce the effect of the surroundings, making detection more accurate. Upon installation, an auto-calibrate sequence is used to adjust detection in order to account for specific ambient environmental surroundings.

Figure 5:
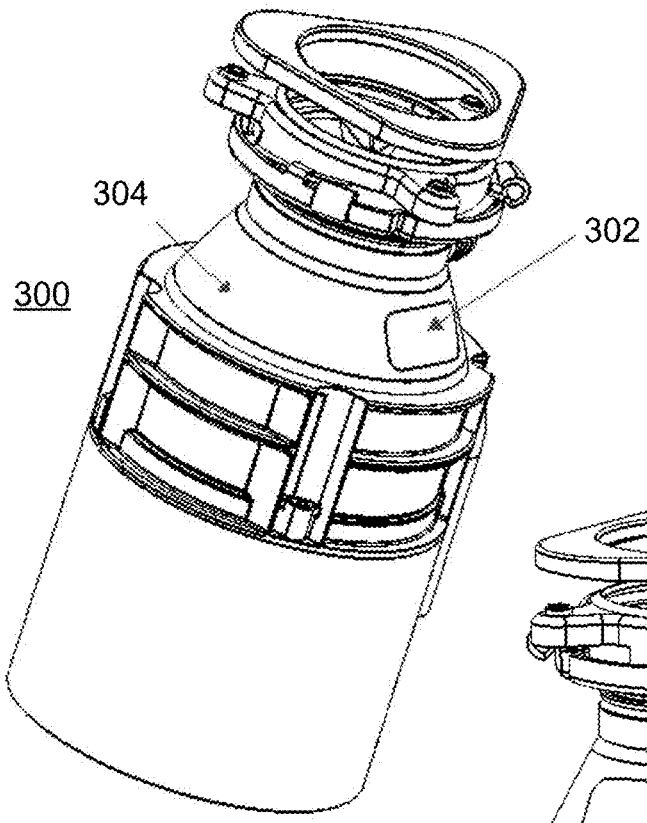
FIG. 5 is a perspective view of a disposal with capacitive plate and shielding.
Figure 6:
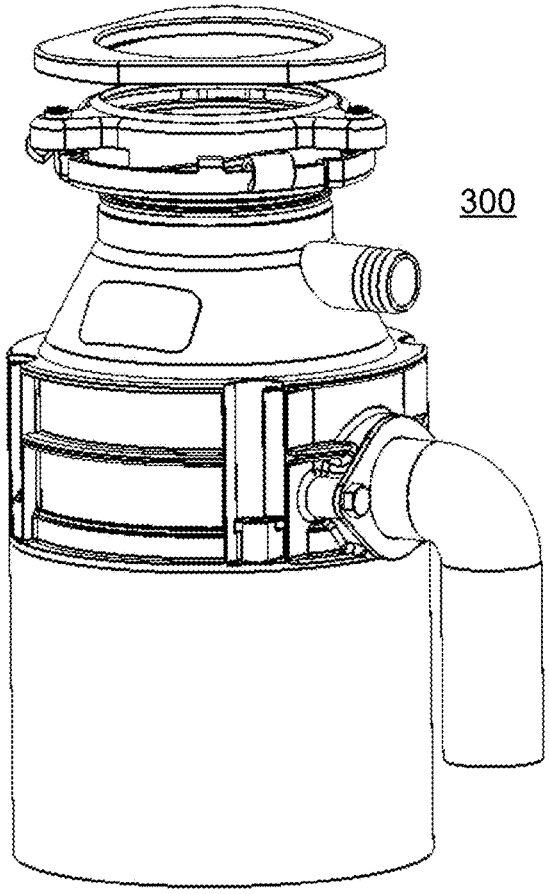
FIG. 6 is another perspective view of the disposal of FIG. 5.
Figure 7:
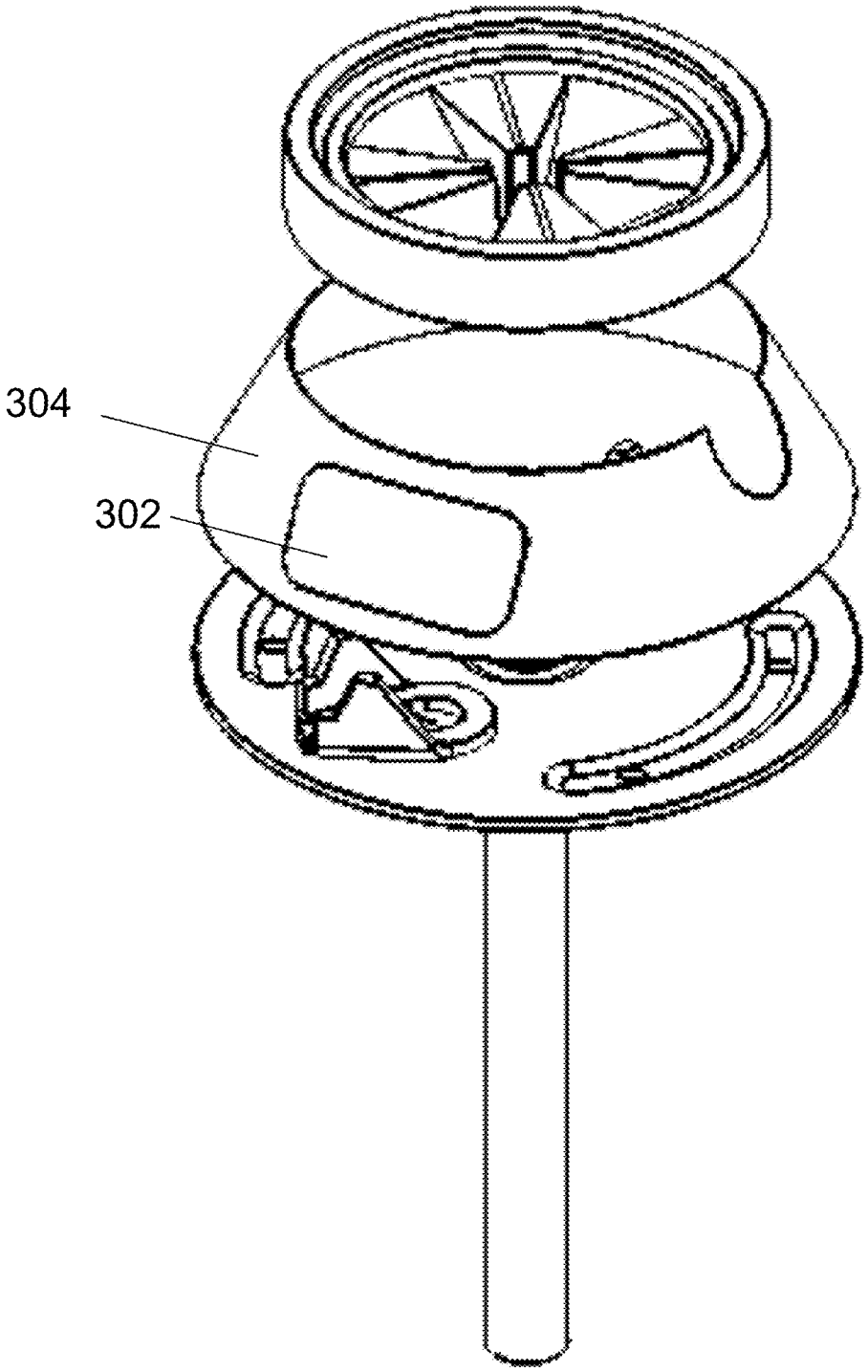
FIG. 7 is a perspective view of the disposal of FIG. 6 in which some components are omitted for clarity of illustration.
Figure 7A:
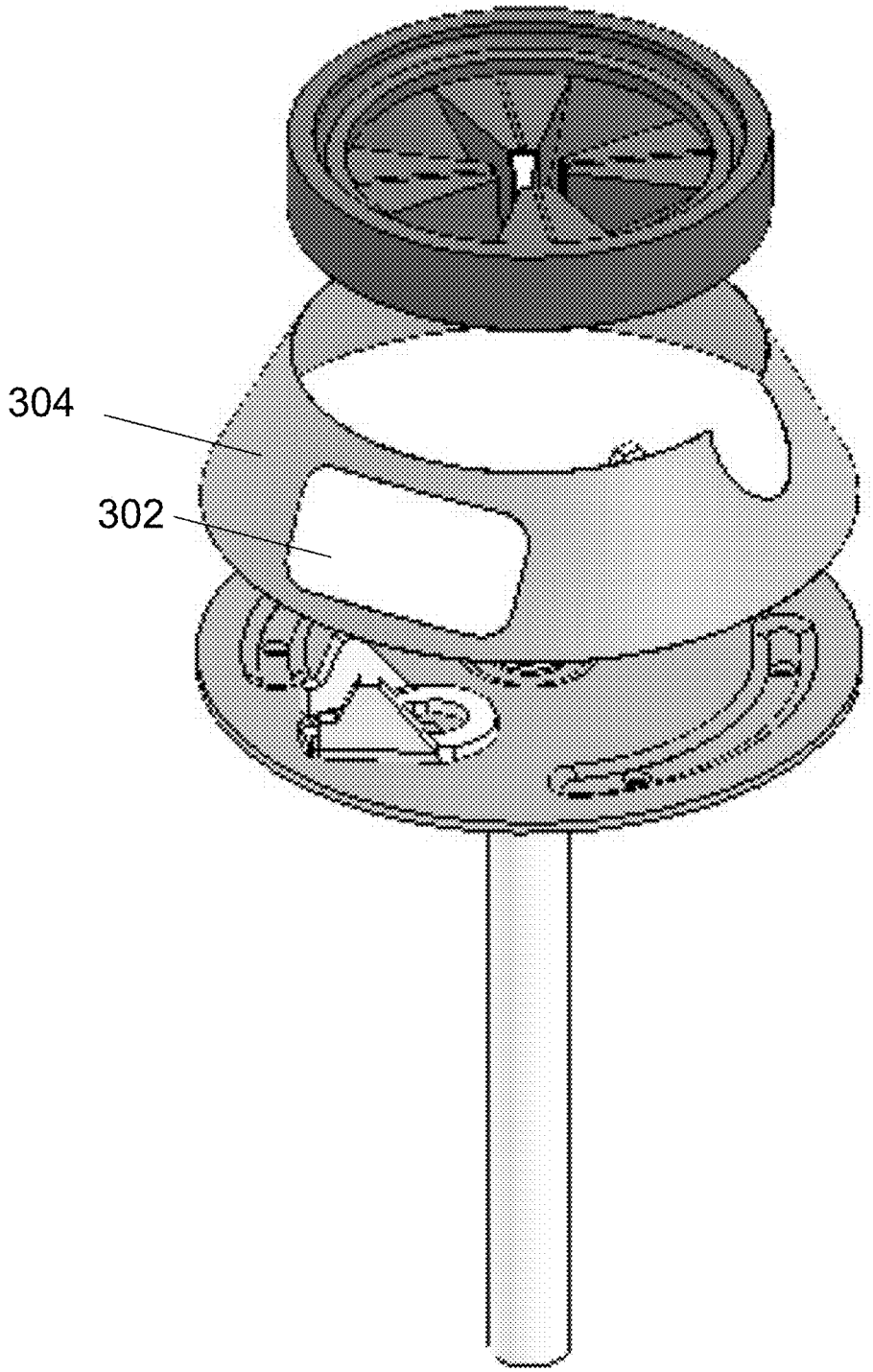
FIG. 7A is a shaded view of FIG. 7.

FIG. 5 is a perspective view of a disposal unit 300 with capacitive plate 302 and shielding 304, of which the disposal unit 200 is representative. Another view of the disposal unit 300 is shown in FIG. 6. Furthermore, FIG. 7 is a perspective view of the disposal unit 300, in which view some components are omitted for clarity of illustration, and FIG. 7A is a shaded view thereof.

Figure 8:
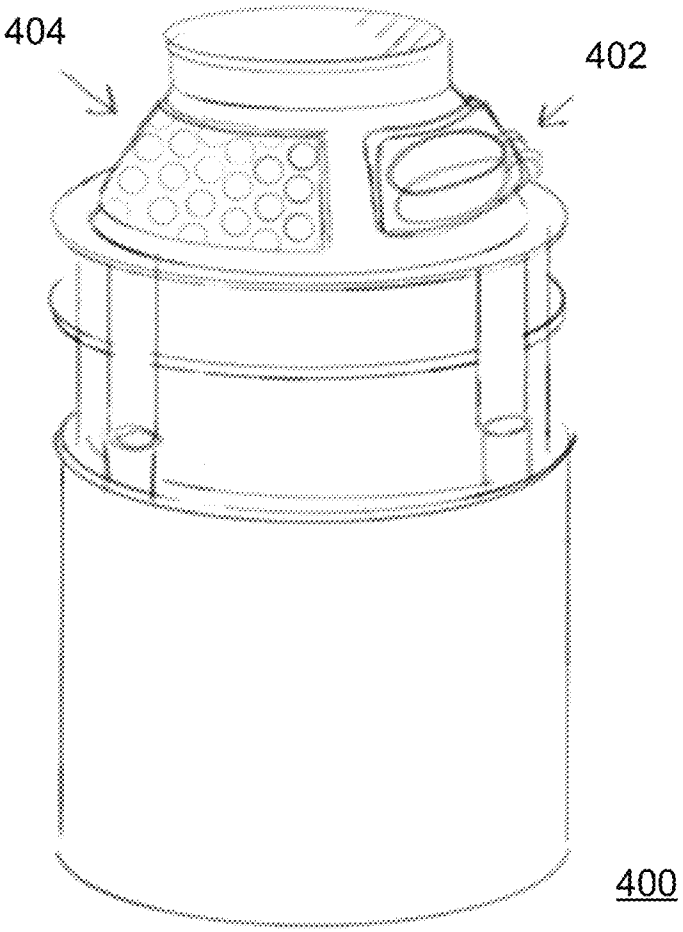
FIG. 8 is a schematic illustration of an embodiment of the invention in which the sensor comprises a double "D" coil arrangement that is used in combination with shielding.

FIG. 8 is a schematic illustration of another embodiment of the invention comprising a disposal unit 400 of which disposal unit 100 is representative, and with which a sensor 402 comprising a double "D" coil arrangement is used in combination with shielding 404. It is believed that the double "D" coil arrangement detects the change in received signal between the source coil and the receive coil, and that the double "D" arrangement produces a planar detection field further reducing the effect of the ambient environment.

Figure 9:
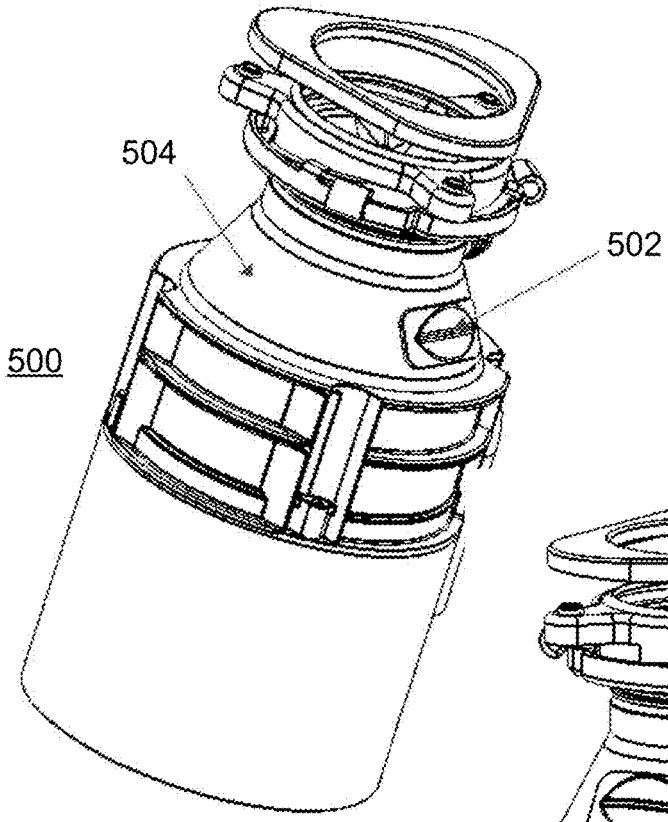
FIG. 9 is a perspective view of a disposal with a sensor having a double "D" coil arrangement and with shielding.
Figure 10:
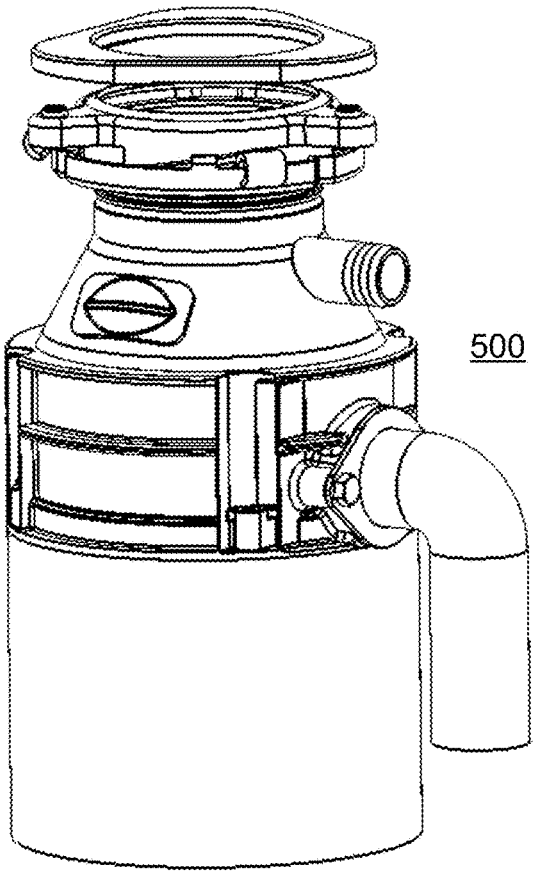
FIG. 10 is another perspective view of the disposal of FIG. 9.
Figure 10A:
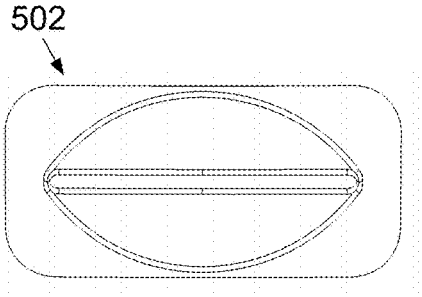
FIG. 10A is a planar schematic illustration of the double "D" of the coil arrangement of the sensor of FIG. 9.
Figure 11:
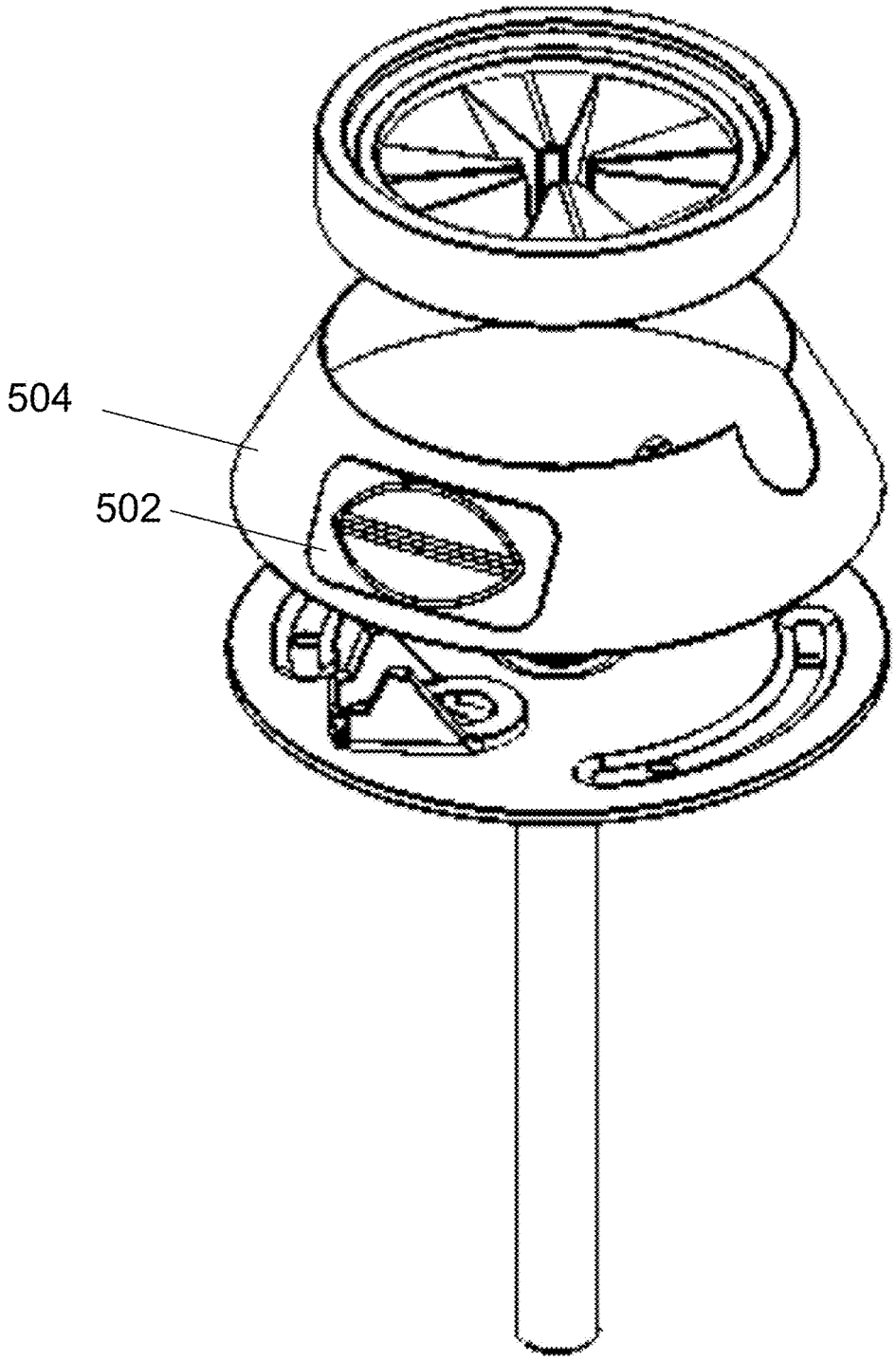
FIG. 11 is a perspective view of the disposal unit of FIG. 10 in which some components are omitted for clarity and illustration.
Figure 11A:
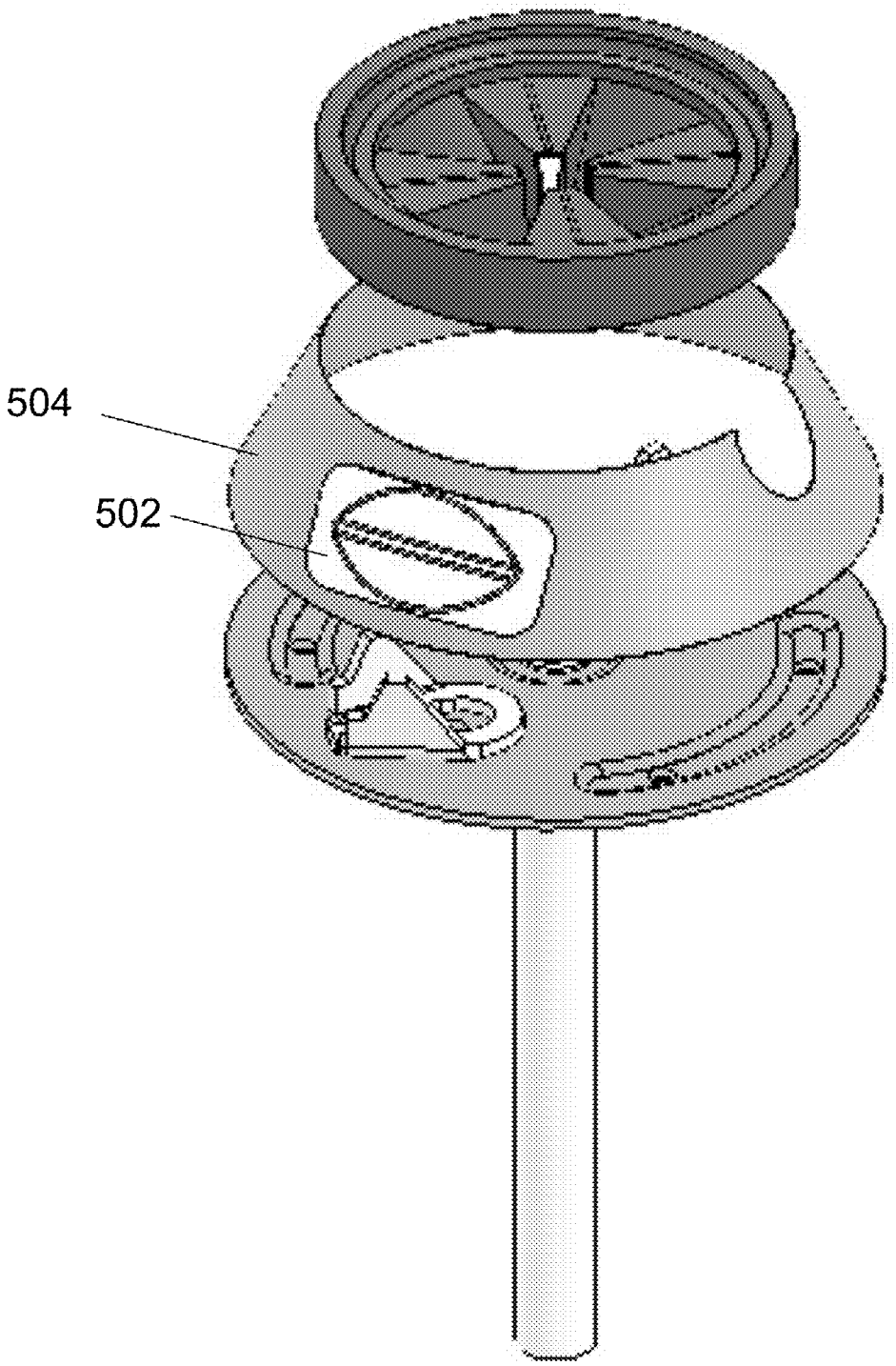
FIG. 11A is a shaded view of FIG. 11.

FIG. 9 is a perspective view of a disposal 500 with a sensor 502 having a double "D" coil arrangement and with shielding 504, of which the disposal 400 is representative. FIG. 10 is another perspective view of the disposal 500, and FIG. 10A is a planar schematic illustration perhaps best representing the double "D" of the sensor 502. Furthermore, FIG. 11 is a perspective view of the disposal 500 in which some components are omitted for clarity of illustration, and FIG. 11A is a shaded view thereof.

Figure 12:
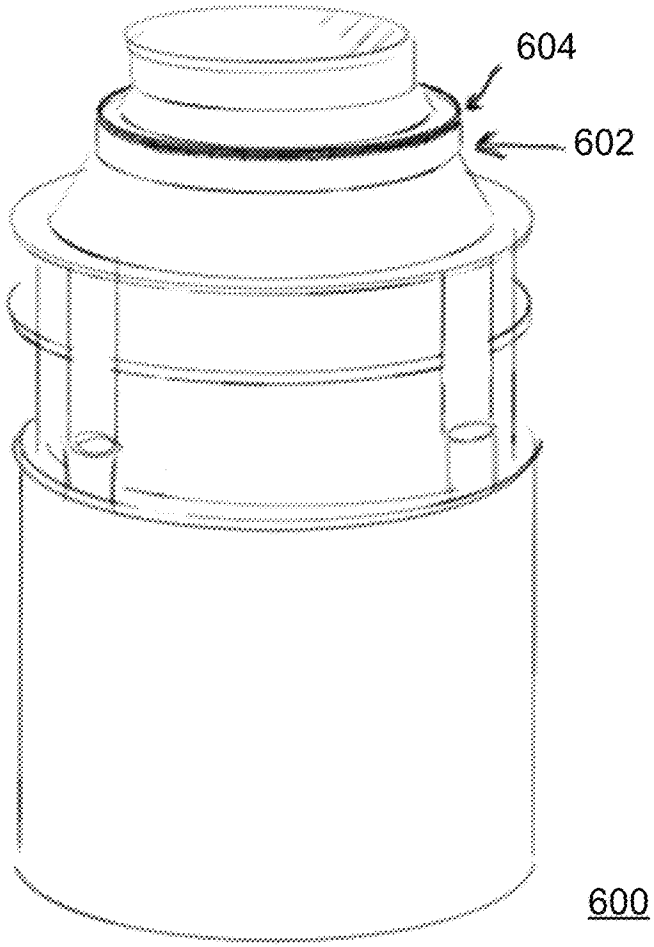
FIG. 12 is a schematic illustration of an embodiment of the invention in which the sensor comprises a concentric detection coil that works based on magnetic ringdown.

FIG. 12 is a schematic illustration of another embodiment of the invention comprising a disposal unit 600 of which disposal unit 100 is representative, and with which is used a sensor 602 comprising a concentric detection coil that works based on magnetic ringdown. In use, the concentric coil works on the principle of magnetic ringdown. Magnetic ringdown creates eddy currents within metallic objects. Once the coil is turned off, the eddy current dissipates causing a magnetic field. This field is then detected by the coil. Magnetic shielding 604 is oriented around the coil to reduce the effect of the ambient environment.

Figure 13:
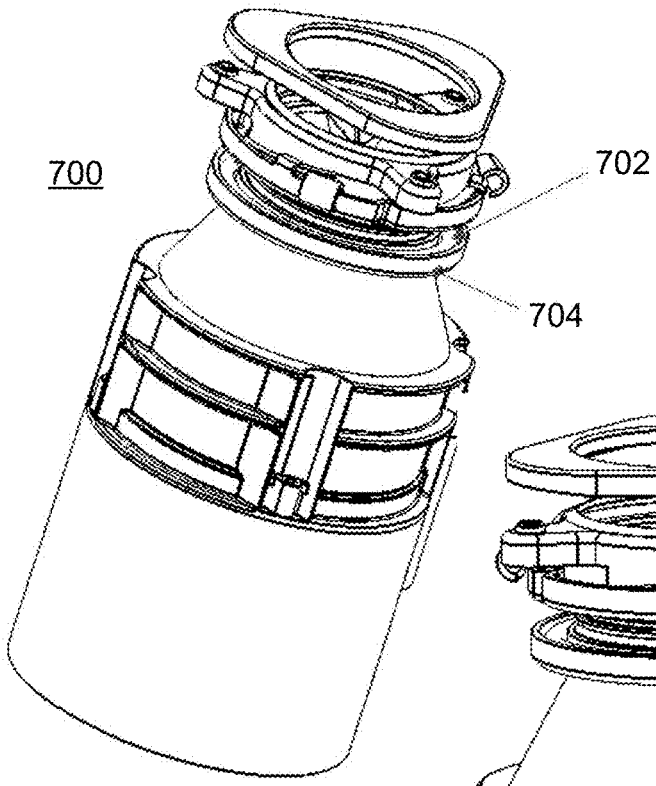
FIG. 13 is a perspective view of a disposal with a sensor having a detection coil, and with accompanying shielding.
Figure 14:
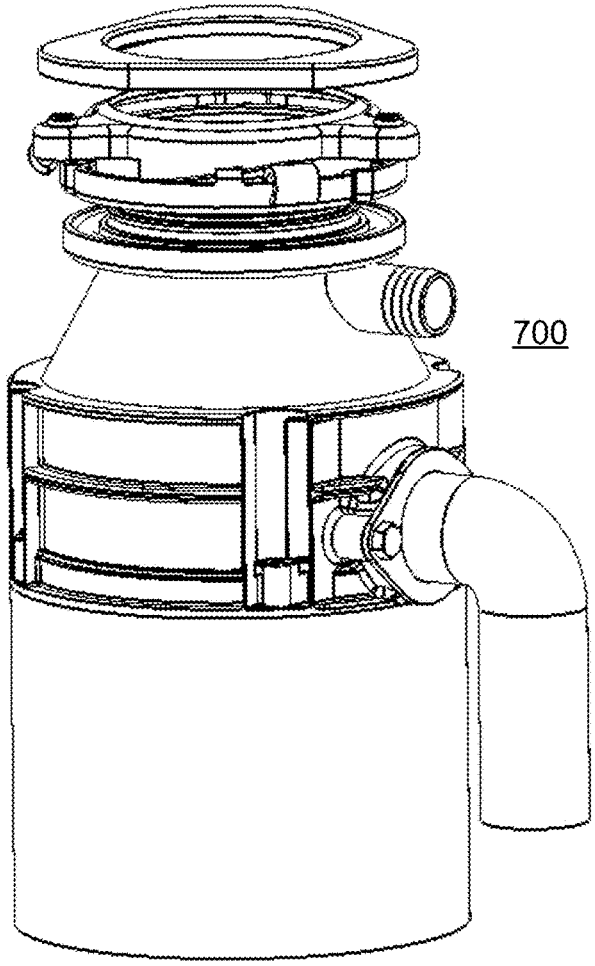
FIG. 14 is another perspective view of the disposal of FIG. 13.
Figure 15:
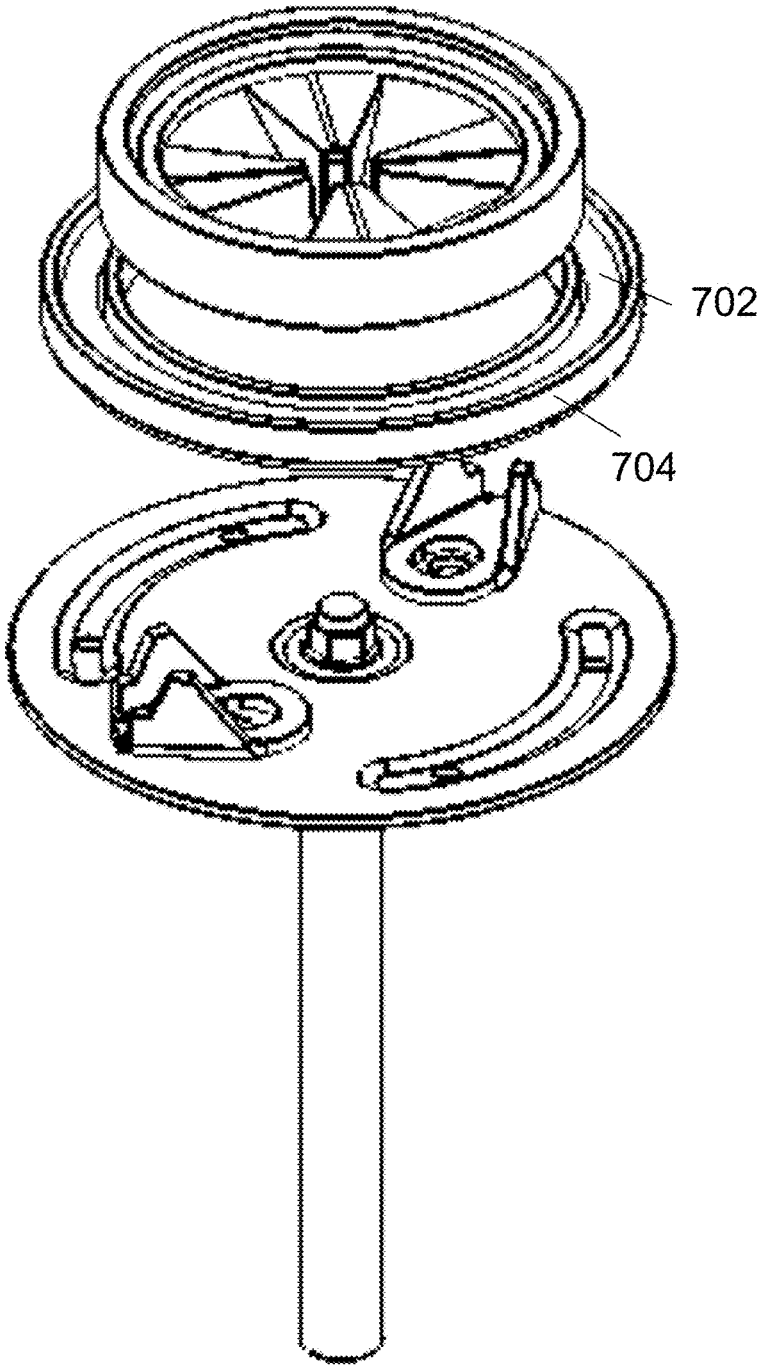
FIG. 15 is a perspective view of the disposal unit of FIG. 14 in which some components are omitted for clarity and illustration.
Figure 15A:
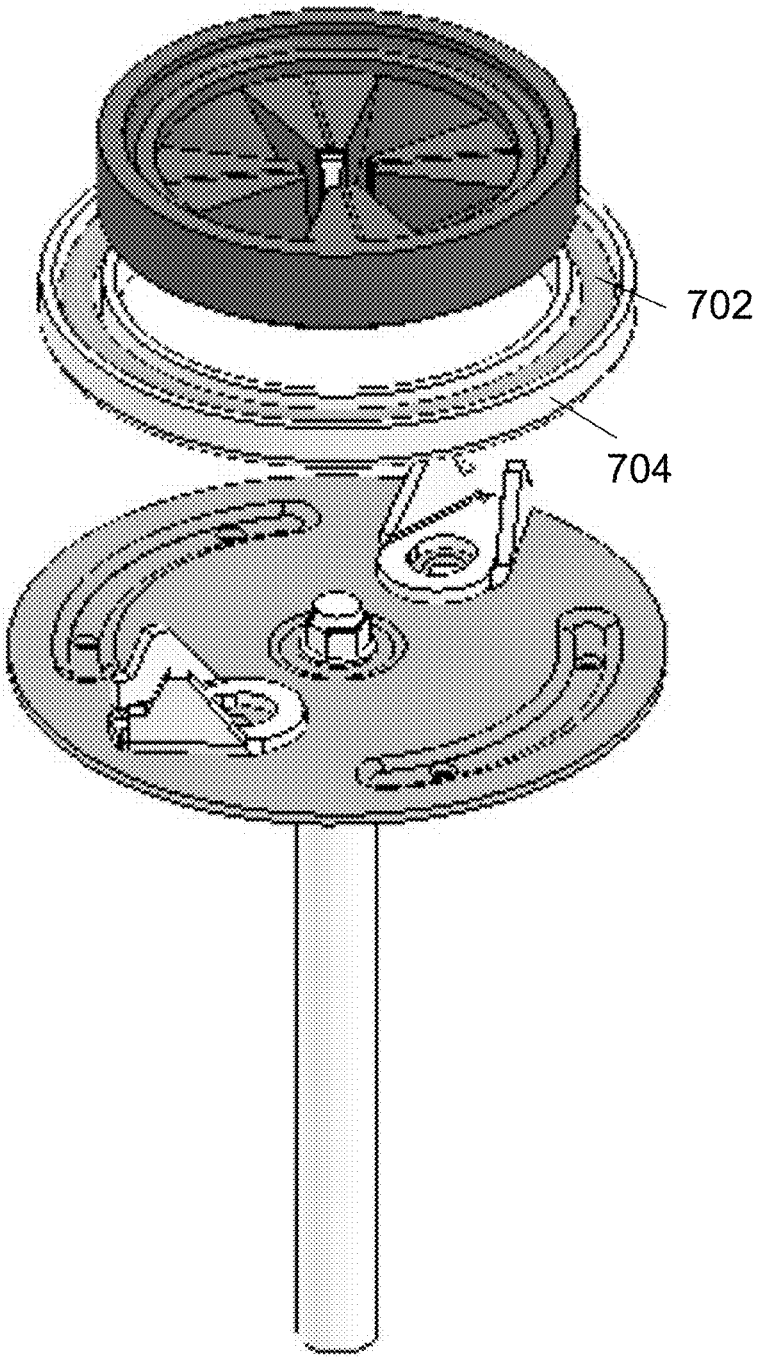
FIG. 15A is a shaded view of FIG. 15.
Figure 16:
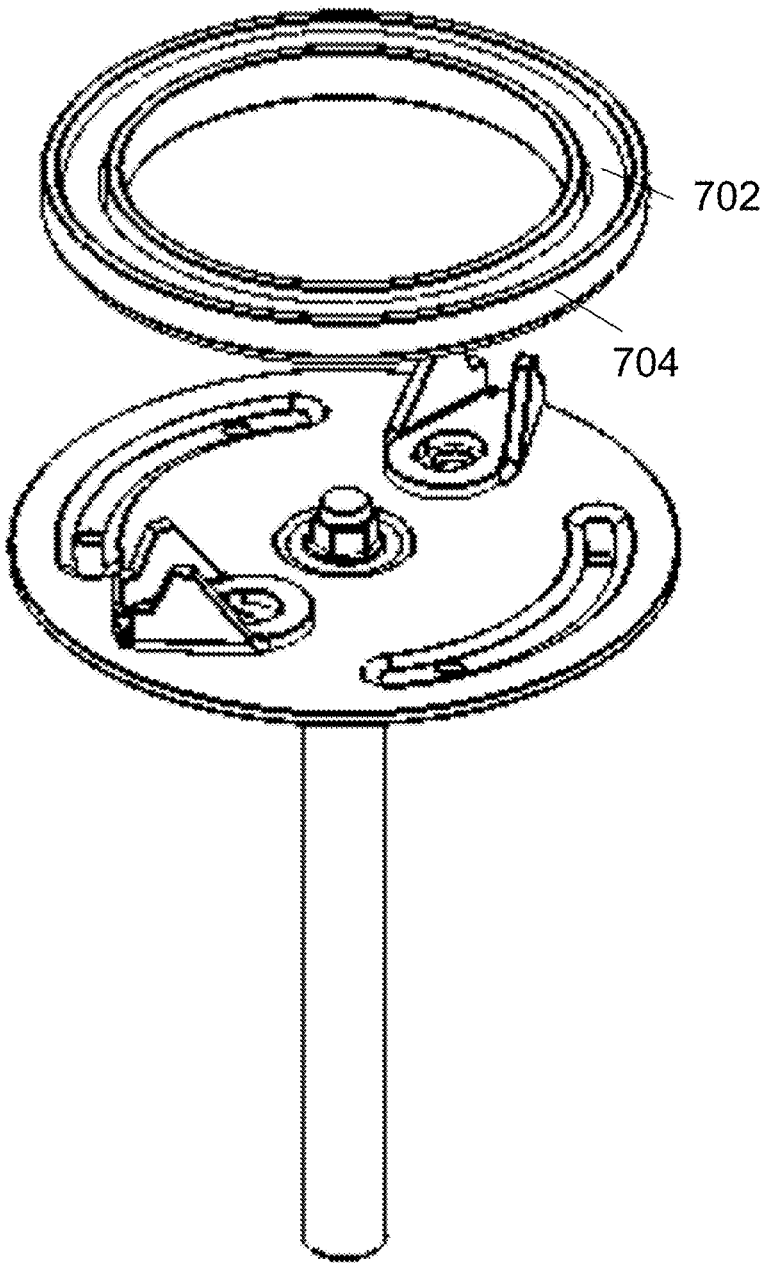
FIG. 16 is a perspective view of the disposal unit of FIG. 15 in which some additional components are omitted for clarity and illustration.
Figure 16A:
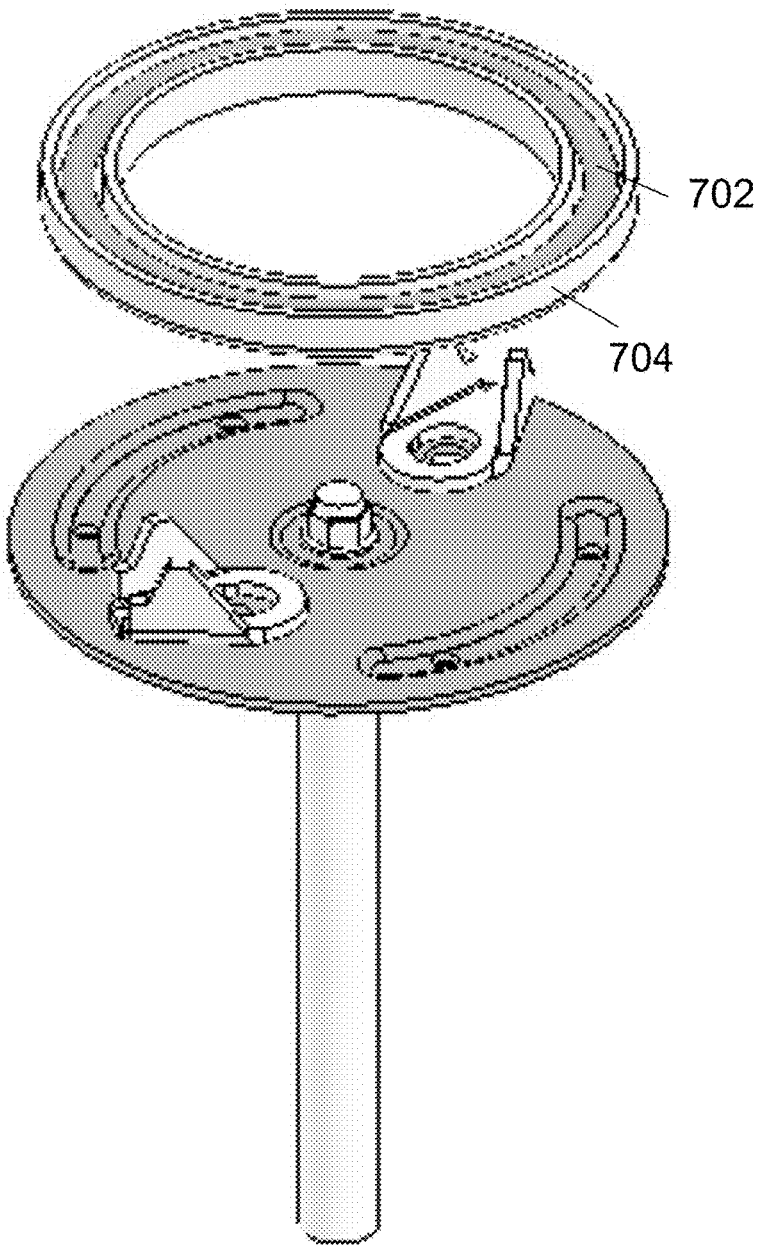
FIG. 16A is a shaded view of FIG. 16.

FIG. 13 is a perspective view of a disposal unit 700 with a sensor 702 having a detection coil, and with accompanying shielding 704, of which the disposal unit 600 is representative. FIG. 14 is another perspective view of the disposal unit 700. Furthermore, FIG. 15 is a perspective view of the disposal unit 700 in which some components are omitted for clarity of illustration, and FIG. 15A is a shaded view thereof; and FIG. 16 is a perspective view of the disposal unit 700 in which some additional components are omitted for clarity of illustration, and FIG. 16A is a shaded view thereof.

Figure 17:
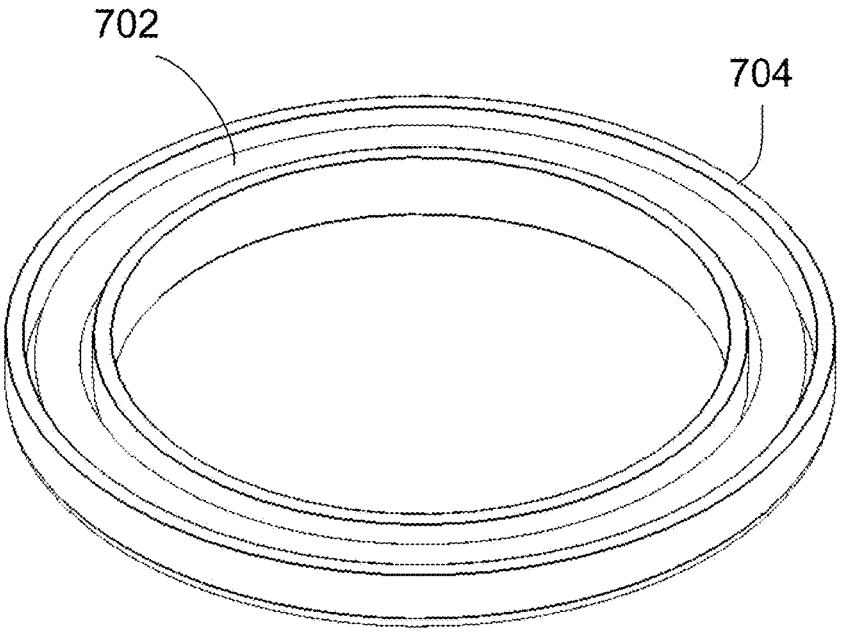
FIG. 17 is a perspective view of a top of the detection coil and accompanying magnetic shielding.
Figure 18:
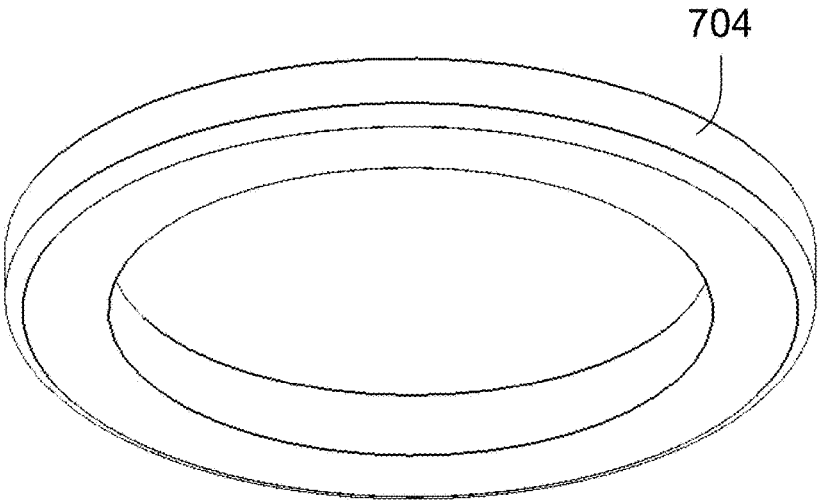
FIG. 18 is a perspective view of a bottom of the detection coil and accompanying magnetic shielding of FIG. 17.
Figure 17A:
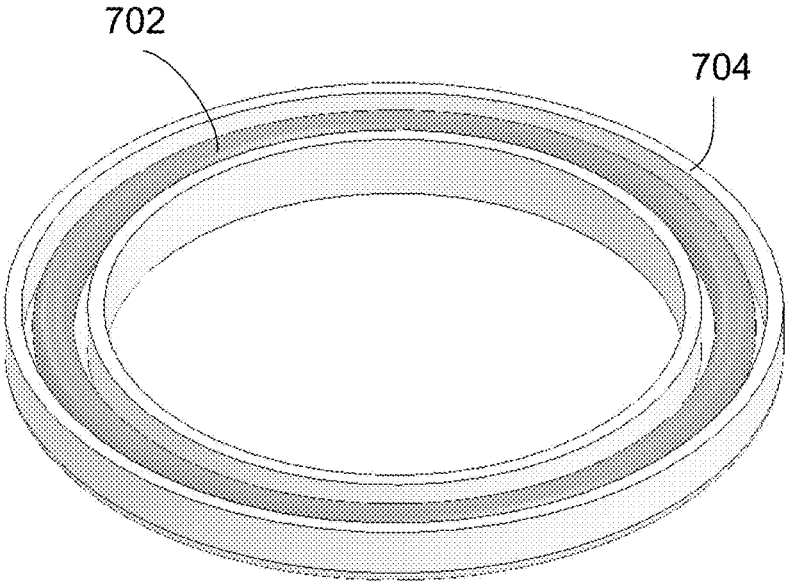
FIG. 17A is a shaded view of FIG. 17.
Figure 18A:
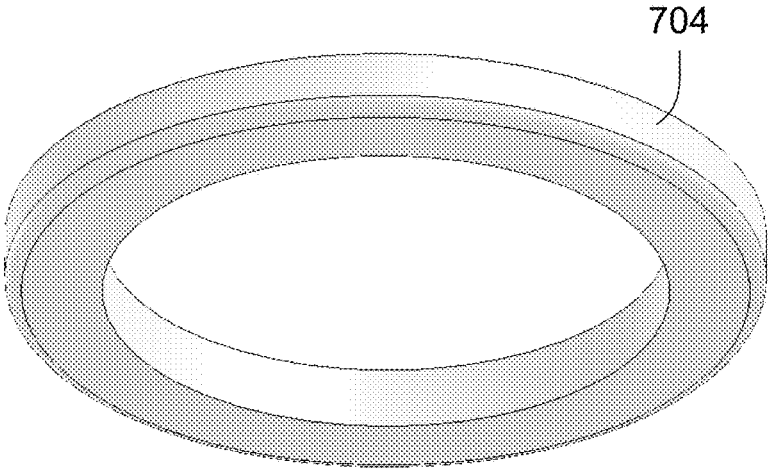
FIG. 18A is a shaded view of FIG. 18.

Continuing in the description of disposal unit 700, FIG. 17 is a perspective view of a top of the detection coil of the sensor 702 together with the accompanying magnetic shielding 704 and FIG. 17A is a shaded view thereof; and FIG. 18 is a perspective view of a bottom of the magnetic shielding 704 of FIG. 17 and FIG. 18A is a shaded view thereof.

Figure 19A:
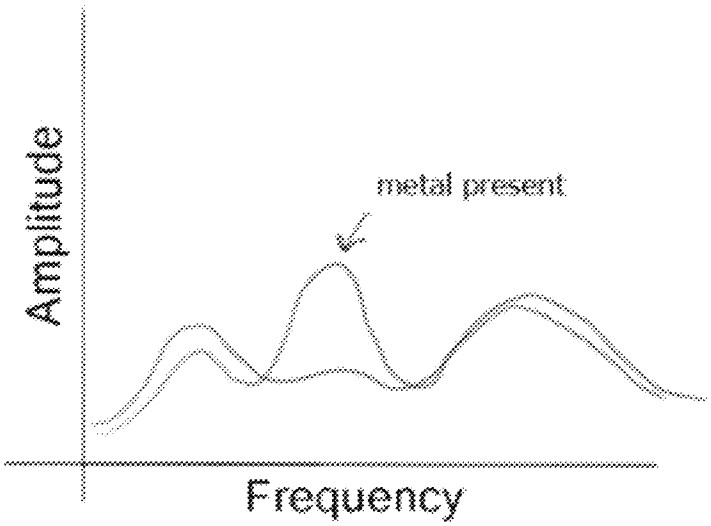
FIG. 19A schematically illustrates a graph representing amplitude versus frequency of a range that is monitored by an ultrasonic sensor, whereby a metallic object located within a disposal unit is detected by reflected waves from an emitter of the sensor.
Figure 19:
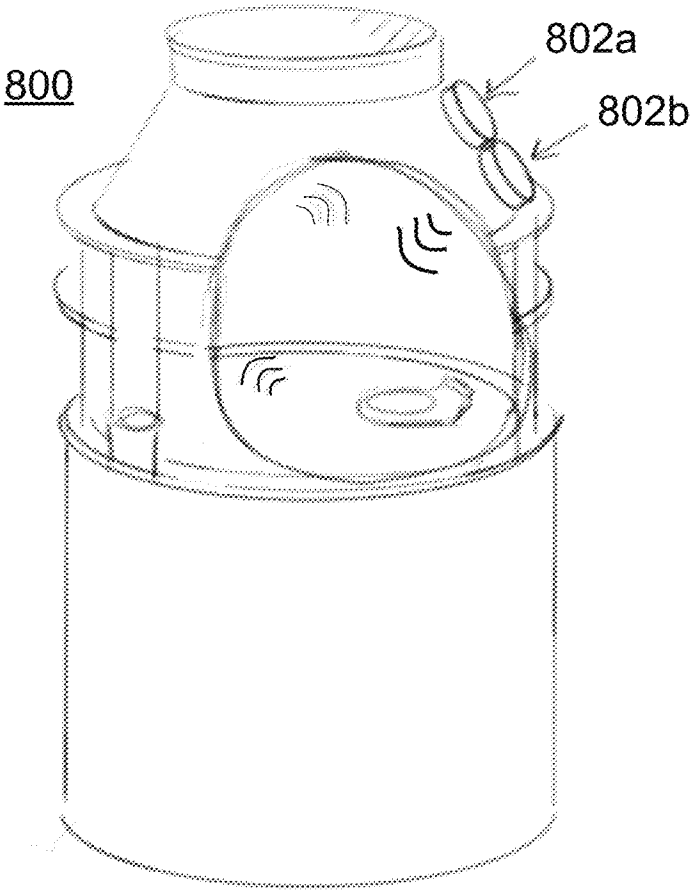
FIG. 19 is a schematic illustration of an embodiment of the invention in which the sensor comprises an ultrasonic sensor.

FIG. 19 is a schematic illustration of another embodiment of the invention comprising a disposal unit 800 of which disposal unit 100 is representative, and with which is used an ultrasonic sensor comprising an ultrasonic receiver 802*a* and ultrasonic emitter 802*b*. In use, an ultrasonic emitter continuously energizes the disposal chamber with acoustic waves. A microphone continually detects the acoustic profile of the chamber. It is believed that the acoustic profile will have a distinct frequency profile when empty. With the addition of a metallic object, the acoustic profile will change. This change is monitored and detected through software, and the detection is recorded. After installation, a calibration sequence determines normal operating profiles including therein environmental factors of the specific installation. As illustrated by the schematic graph of FIG. 19A, it is believed that metallic objects will cause the profile to be different from those of normal operating profiles, thereby indicating the presence of the metallic object.

Figure 20:
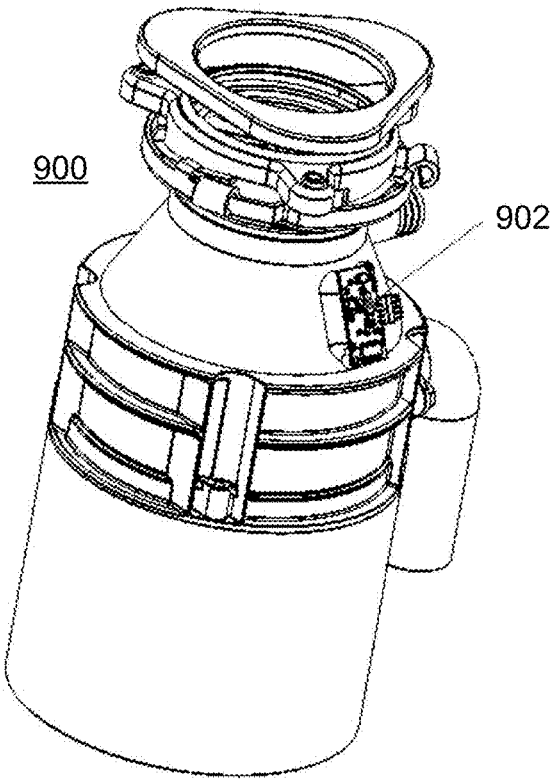
FIG. 20 is a perspective view of a disposal with an ultrasonic sensor.
Figure 21:
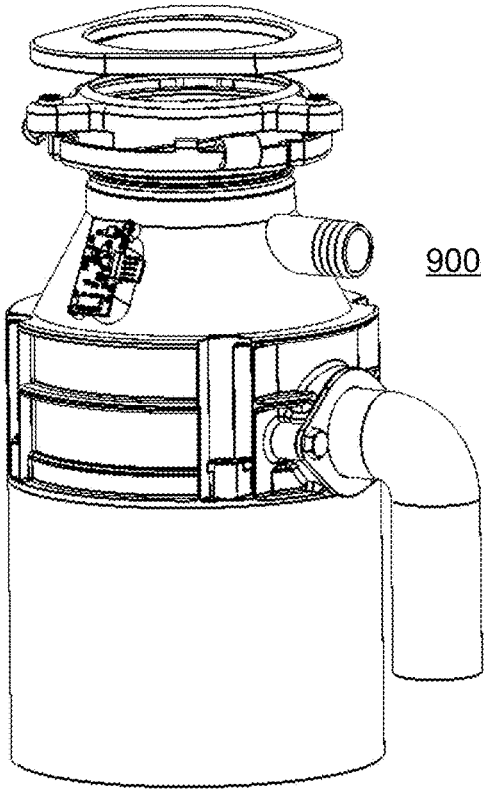
FIG. 21 is another perspective view of the disposal of FIG. 20.
Figure 22:
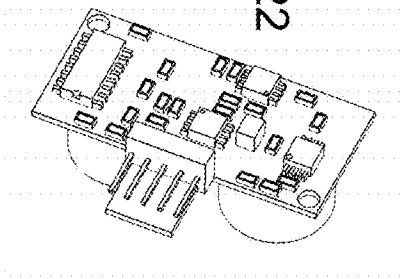
FIGS. 22-28 are views of the ultrasonic sensor of the disposal of FIGS. 20-21.
Figure 23:
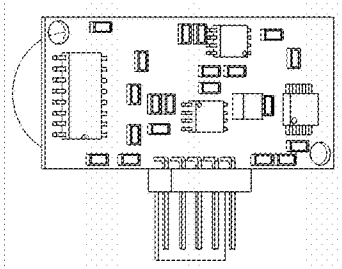
Figure 24:
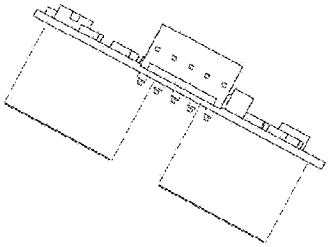
Figure 25:
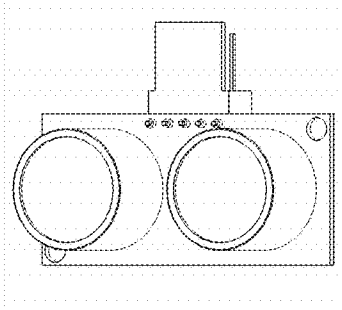
Figure 26:
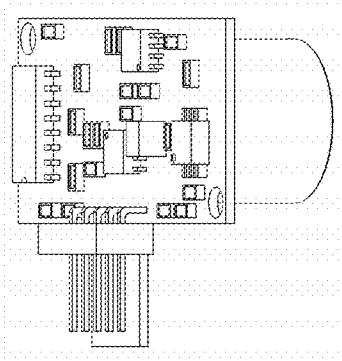
Figure 27:
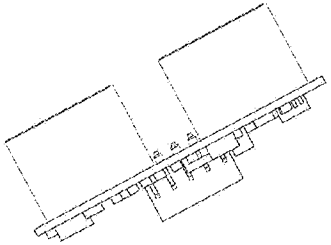
Figure 28:
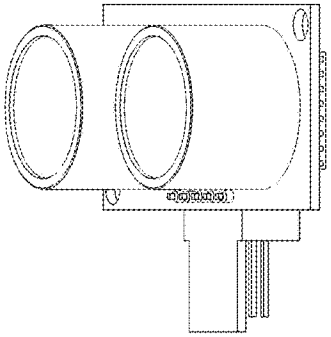

FIG. 20 is a perspective view of a disposal unit 900 with an ultrasonic sensor 902, of which the disposal unit 800 is representative. FIG. 21 is another perspective view of the disposal unit 900, and FIGS. 22-28 schematically illustrate views of the ultrasonic sensor 902.

Figures 29, 29A:
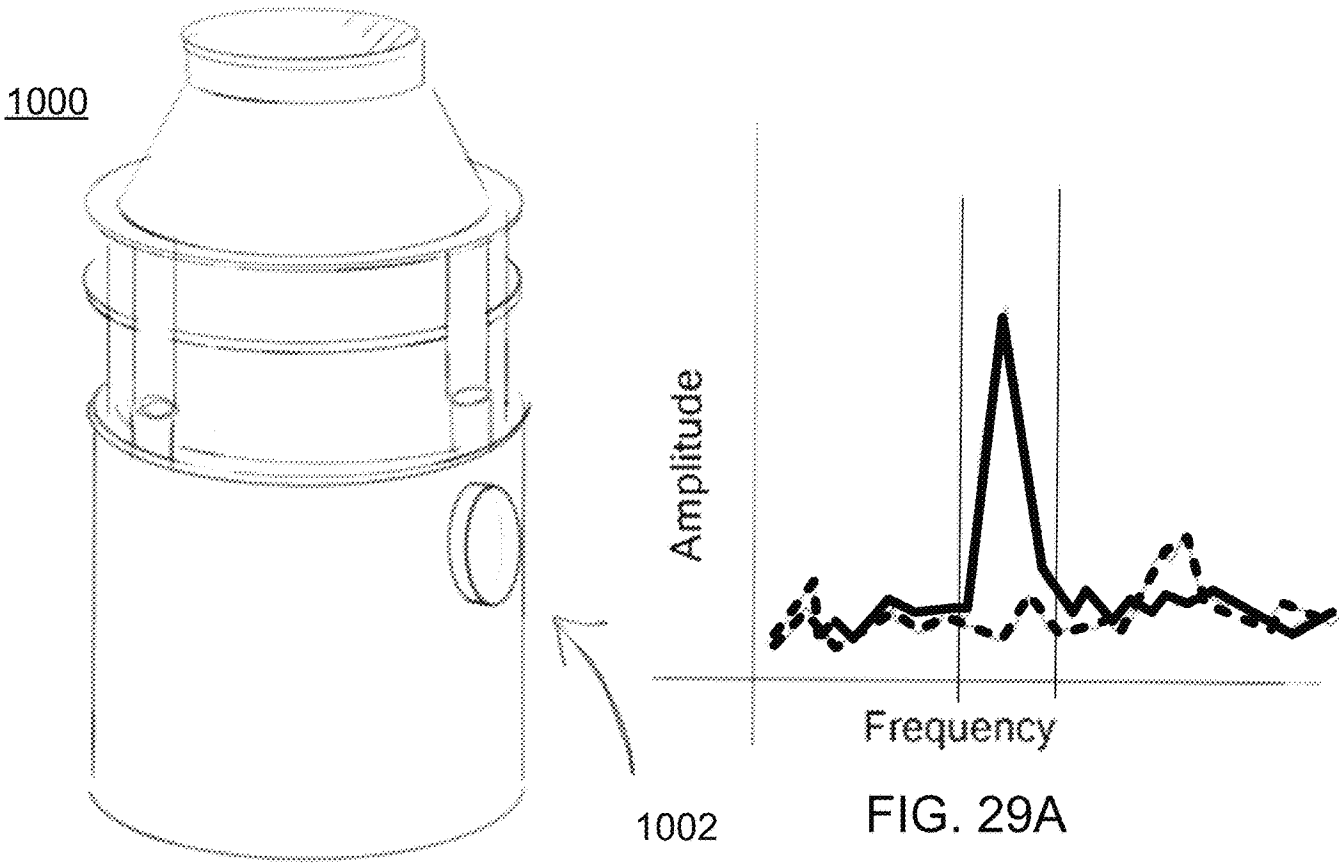
FIG. 29 is a schematic illustration of an embodiment of the invention in which the sensor comprises a microphone.
FIG. 29A schematically illustrates a graph representing amplitude versus frequency of a range that is monitored by a microphone, whereby a metallic object striking metal within a disposal unit is "heard" and thereby detected.

Lastly, FIG. 29 is a schematic illustration of another embodiment of the invention comprising a disposal unit 1000 of which disposal unit 100 is representative, and with which is used a sensor comprising a microphone 1002. In use, the microphone is used to monitor a frequency band representing metal on metal contact. As schematically represented in the graph of FIG. 29A, the dashed line is representative of no metal being heard in the shredding area of the disposal unit 1000, and the solid line is representative of a metallic object that is "heard" in the shredding area of the disposal unit 1000. The metal is heard as a metallic object strikes a metal wall within the disposal unit 1000. Preferably, upon starting the motor spins slowing initially. If any metallic object is heard, then the motor is deactivated. If a metallic object is heard after the initial startup while the motor is running and waste is being shredded, then the motor is likewise deactivated.

Figure 30:
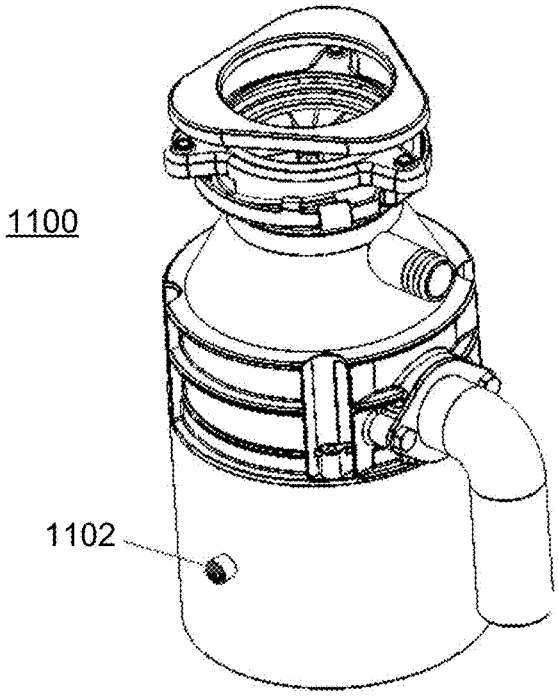
FIG. 30 is a perspective view of a disposal with a sensor comprising a microphone.
Figure 31:
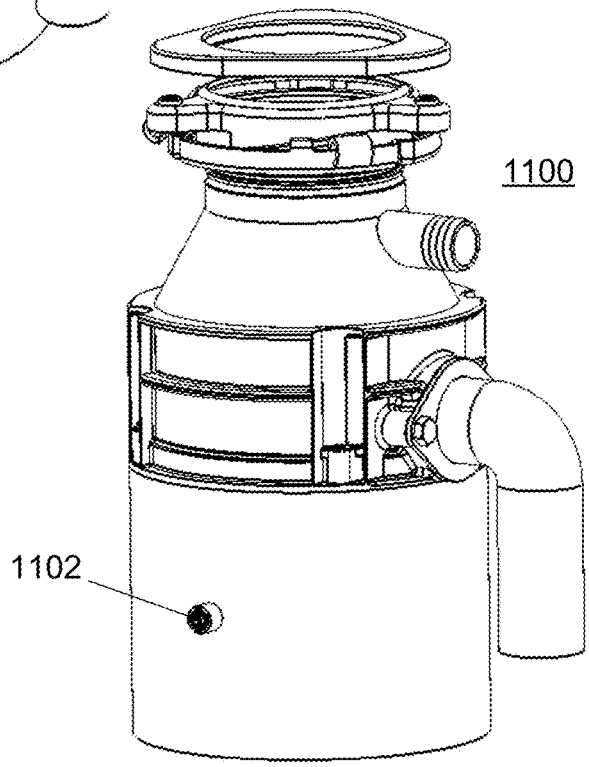
FIG. 31 is another perspective view of the disposal of FIG. 30.

FIG. 30 is a perspective view of a disposal unit 1100 with a sensor 1102 comprising a microphone, of which the disposal unit 1000 is representative, and FIG. 31 is another perspective view of the disposal unit 1100.

Of course, it will be appreciated the circuitry operatively connected to—and in some cases forming a part of—the sensor in each of the foregoing schematically illustrated embodiments is operative to trigger a control unit (not shown) of the disposal unit for stopping shredding operation of the disposal unit. Such circuitry and control unit has been omitted in the drawings where not shown for clarity of illustration.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An apparatus, comprising:

(a) an under-sink disposal;

(b) a controller configured to operate the disposal; and (c) a sensor and associated circuitry that detects a metallic object that enters the disposal and that triggers the controller to stop shredding operation of the disposal;

(d) wherein the sensor comprises a coil arrangement located adjacent to a disposal chamber of the disposal, the coil arrangement comprising a source coil for transmitting signals and a receive coil for receiving the signals, wherein the coil arrangement creates a detection field such that a metallic object that enters the disposal passes by the coil arrangement and through the detection field, but does not pass through either of the source coil and the receive coil; and (e) wherein the sensor is located above a shredding area that is located at a bottom of the disposal chamber of the disposal, the sensor and associated circuitry being configured to trigger the controller to stop shredding operation of the disposal.

2. The apparatus of claim 1, wherein the sensor comprises magnetic shielding surrounding the disposal in the area of the sensor.

3. The apparatus of claim 1, wherein the sensor and associated circuitry are configured to detect precious metals.

4. The apparatus of claim 1, wherein the under-sink disposal further comprises a microphone that detects a metallic object in the shredding area of the disposal and triggers the controller to stop shredding operation of the disposal.

5. The apparatus of claim 4, wherein a frequency band representing metal on metal contact is monitored by the microphone.

6. The apparatus of claim 1, wherein the controller turns off power to the disposal to stop shredding operation of the disposal when triggered by the sensor and associated circuitry.

7. The apparatus of claim 1, wherein the controller causes active braking of a shredding mechanism of the disposal when the sensor and associated circuitry triggers the controller.

8. The apparatus of claim 1, further comprising a capacitive sensor that is located adjacent to the disposal chamber of the disposal such that a metallic object that enters the disposal passes by the capacitive sensor, the capacitive sensor and the associated circuitry being configured to trigger the controller to stop shredding operation of the disposal.

9. The apparatus of claim 8, wherein the capacitive sensor is attached to a housing of the disposal.

10. The apparatus of claim 8, wherein the capacitive sensor comprises a capacitive plate.

11. The apparatus of claim 8, wherein the capacitive sensor is attached to a side of the disposal.

12. The apparatus of claim 8, wherein the capacitive sensor does not encircle the disposal.

13. The apparatus of claim 8, wherein the under-sink disposal further comprises a microphone that detects a metallic object in the shredding area of the disposal and triggers the controller to stop shredding operation of the disposal.

14. The apparatus of claim 13, wherein a frequency band representing metal on metal contact is monitored by the microphone.

15. The under-sink disposal of claim 1, further comprising an ultrasonic sensor comprising an ultrasonic emitter and ultrasonic receiver that are located adjacent to the disposal chamber of the disposal, the ultrasonic sensor and the associated circuitry being configured to trigger the controller to stop shredding operation of the disposal.

16. The apparatus of claim 15, wherein the controller turns off power to the disposal to stop shredding operation of the disposal when triggered by the ultrasonic sensor and the associated circuitry.

17. The apparatus of claim 15, wherein the under-sink disposal further comprises a microphone that detects a metallic object in the shredding area of the disposal and triggers the controller to stop shredding operation of the disposal.

18. The apparatus of claim 17, wherein a frequency band representing metal on metal contact is monitored by the microphone.

19. An apparatus, comprising:

(a) an under-sink disposal;

(b) a controller configured to operate the disposal; and (c) a sensor and associated circuitry that detects a metallic object that enters the disposal and that triggers the controller to stop shredding operation of the disposal;

(d) wherein the sensor comprises a coil arrangement located adjacent to a disposal chamber of the disposal, the coil arrangement comprising a source coil for transmitting signals and a receive coil for receiving the signals, wherein the coil arrangement creates a detection field such that a metallic object that enters the disposal passes by the coil arrangement and through the detection field, but does not pass through either of the source coil and the receive coil;

(e) wherein the sensor is located above a shredding area that is located at a bottom of the disposal chamber of the disposal, the sensor and associated circuitry being configured to trigger the controller to stop shredding operation of the disposal; and (f) wherein the source coil and the receive coil comprise "D" shaped coils and are arranged in generally mirror image to each other for creating a generally planar detection field that intersects an axis of the disposal chamber of the disposal.

20. An apparatus, comprising:

(a) an under-sink disposal;

(b) a controller configured to operate the disposal; and (c) a sensor and associated circuitry that detects a metallic object that enters the disposal and that triggers the controller to stop shredding operation of the disposal;

(d) wherein the sensor comprises a coil arrangement located adjacent to a disposal chamber of the disposal, the coil arrangement comprising a source coil for transmitting signals and a receive coil for receiving the signals, wherein the coil arrangement creates a detection field such that a metallic object that enters the disposal passes by the coil arrangement and through the detection field, but does not pass through either of the source coil and the receive coil;

(e) wherein the sensor is located above a shredding area that is located at a bottom of the disposal chamber of the disposal, the sensor and associated circuitry being configured to trigger the controller to stop shredding operation of the disposal; and (f) wherein the sensor is attached to a side of the disposal and does not encircle the disposal.

* * * * *